US007878636B2

(12) United States Patent
Fairchild et al.

(10) Patent No.: US 7,878,636 B2
(45) Date of Patent: Feb. 1, 2011

(54) SOLID INK STICK CHUTE FOR PRINTER SOLID INK TRANSPORT WITH MATING SOLID INK STICK CHUTE

(75) Inventors: Michael Alan Fairchild, Vancouver, WA (US); Ernest Isreal Esplin, Sheridan, OR (US)

(73) Assignee: Xerox Corporation, Norwalk, CT (US)

( * ) Notice: Subject to any disclaimer, the term of this patent is extended or adjusted under 35 U.S.C. 154(b) by 891 days.

(21) Appl. No.: 11/637,559

(22) Filed: Dec. 12, 2006

(65) Prior Publication Data

US 2008/0136882 A1 Jun. 12, 2008

(51) Int. Cl.
*B41J 2/175* (2006.01)

(52) U.S. Cl. ..... 347/88; 347/99; 347/103

(58) Field of Classification Search ..... 347/103, 347/88, 99

See application file for complete search history.

(56) References Cited

U.S. PATENT DOCUMENTS

| | | | | |
|---|---|---|---|---|
| 5,181,049 | A * | 1/1993 | Mackay et al. | 347/88 |
| D335,683 | S | 5/1993 | Smith | |
| 5,223,860 | A | 6/1993 | Loofbourow et al. | |
| 5,341,164 | A | 8/1994 | Miyazawa et al. | |
| 5,442,387 | A | 8/1995 | Loofbourow et al. | |
| 5,734,402 | A | 3/1998 | Rousseau et al. | |
| 5,784,089 | A | 7/1998 | Crawford | |
| 5,861,903 | A | 1/1999 | Crawford et al. | |
| 5,917,528 | A | 6/1999 | Grellmann et al. | |
| 5,975,690 | A | 11/1999 | Grellmann et al. | |
| 6,053,608 | A | 4/2000 | Ishii et al. | |
| 6,705,710 | B2 | 3/2004 | Jones et al. | |
| 6,722,764 | B2 * | 4/2004 | Jones et al. | 347/88 |
| 6,739,713 | B2 | 5/2004 | Jones et al. | |
| 6,755,517 | B2 | 6/2004 | Jones et al. | |
| 6,761,443 | B2 | 7/2004 | Jones | |
| 6,824,241 | B2 | 11/2004 | Sonnichsen et al. | |
| D500,783 | S | 1/2005 | Jones et al. | |
| 6,840,612 | B2 | 1/2005 | Jones et al. | |
| 6,840,613 | B2 | 1/2005 | Jones | |
| 6,966,644 | B2 | 11/2005 | Jones et al. | |
| D531,211 | S | 10/2006 | Korn et al. | |
| 2005/0062820 | A1 * | 3/2005 | Jones et al. | 347/99 |
| 2008/0117264 | A1 * | 5/2008 | Fairchild et al. | 347/85 |
| 2008/0117265 | A1 * | 5/2008 | Esplin et al. | 347/85 |
| 2008/0117272 | A1 * | 5/2008 | Esplin et al. | 347/88 |

* cited by examiner

*Primary Examiner*—Manish S Shah
(74) *Attorney, Agent, or Firm*—Maginot, Moore & Beck LLP

(57) ABSTRACT

An ink stick for use in solid ink printers is provided. The ink stick is for use in a solid ink delivery system for delivering ink to a melting unit to melt the solid ink. The ink stick has opposed first and second stick external surfaces. At least one of the first and second stick external surfaces is arcuate.

5 Claims, 30 Drawing Sheets

SOLID INK STICK CHUTE FOR PRINTER SOLID INK TRANSPORT WITH MATING SOLID INK STICK CHUTE

1. TECHNICAL FIELD

The system disclosed herein generally relates to high speed printers which have one or more printheads that receive molten ink heated from solid ink sticks. More specifically, the system disclosed herein relates to improving the ink transport system design and functionality.

2. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages ink sticks which remain in solid form at room temperatures. The ink stock can be refilled by a user by simply adding more ink as needed to the ink loader 110. Separate loader channels are used for the different colors. For, example, only black ink is needed for monochrome printing, while ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink.

In typical prior art ink chutes or stick reservoirs, the sticks are positioned end to end in straight or linear channels or chutes with a melt head on one end and a spring biased push stick on the other end. As these solid ink printers have high productivity rates, the storage of ample supplies of ink is very desirable. As the space in solid ink printers is limited, finding a location within the printer to accommodate a long straight chute for holding an ample supply of ink is a challenge. The amount of ink that can be accommodated is limited by the physical dimensions of the printer and can not be greater that the amount accommodated by a linear chute diagonally positioned in the printer.

Typically, prior art solid ink printers have utilized ink chutes with rectangular cross-sections that receive rectangular ink sticks. The use of such linear chutes limits the amount of ink and ink sticks that may be provided in a machine of a particular size. When providing ink sticks and chutes with shapes other than linear chutes with rectangular cross-sections and rectangular sticks, issues such as buckling and camming of the sticks may occur. The use of rectangular sticks in chutes that are curved or have an arcuate portion may create issues in that they may not move smoothly along the curved portion of the chute.

3. SUMMARY

In view of the above-identified problems and limitations of the prior art and alternate ink and ink loader forms, the system disclosed herein provides a solid ink supply system adapted for use with solid ink printers.

According to one embodiment of the system disclosed herein, an ink stick for use in solid ink printers is provided. The ink stick is for use in a solid ink delivery system for delivering solid ink to a melting unit to melt the solid ink. The ink stick has opposed first and second stick external surfaces. At least one of the first and second stick external surfaces is arcuate.

According to another embodiment of the system disclosed herein, a solid ink delivery system for use with an ink stick for use in solid ink printers is provided. The solid ink delivery system delivers the stick to a melting station for melting the stick. The stick has opposed first and second stick external surfaces. The first and/or second stick external surface is arcuate. The delivery system includes a chute for guiding the stick in a prescribed path. The chute guides the stick. The chute has opposed first and second chute internal surfaces for guiding the first and second surfaces, respectively, of the stick.

According to yet another embodiment of the system disclosed herein, a solid ink printer including a solid ink delivery system for use with an ink stick is provided. The solid ink delivery system delivers the stick to a melting station for melting the stick so that the ink may be transferred to media to form an image on the media. The stick has opposed first and second stick external surfaces. The first and/or second stick external surfaces is arcuate. The delivery system includes a chute for guiding the stick in a prescribed path. The chute guides the stick. The chute has opposed first and second chute internal surfaces for guiding the first and second surfaces, respectively, of the stick.

The system disclosed herein is fundamentally an ink delivery system for solid ink printers that utilizes a combination of an at least partially curved stick and mating chute, curved over at least a portion of its length to advance the ink from the loading station to the melting station to transfer ink to one or more printheads. The many additional described features of this ink delivery system, which can be selectively incorporated individually or in any combination, enable many additional printer system opportunities, including lower cost, enlarged ink storage capacity, as well as, less jamming and camming as an alternative (upgrade) or addition (volume/delivery supplement) to more typical ink delivery systems. The unique arcuate or curved portion of at least one side of an ink stick permits the stick to be guided or fed in a non linear ink delivery system feed path, the path being at least partially arcuate and not limited to a constant or two dimensional radius. The referenced curved portion of the stick is the predominant arcuate form and does not automatically include termination radii of the arcuate portion or other such minor arcuate aesthetic or fabrication features, particularly with respect to mating arcuate portions of the chute which confines and guides the stick. The terms guide and guidance refer to the broad function of influencing position and feed direction and may be or include constraint or confinement against excessive motion or free play in axes other than the feed axis. Confining or guiding surfaces of the chute may be discontinuous or partial forms with gaps, openings, slots or other configurations with incomplete sections and may have complex or varying cross section shapes and may be augmented or supplanted by other guiding elements at various locations along the feed path, such as by driving members or movable/flexing components that influence position of the ink stick.

4. BRIEF DESCRIPTION OF THE DRAWINGS

Features of the system disclosed herein will become apparent to those skilled in the art from the following description with reference to the drawings, in which.

5. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the system disclosed herein.

The general components of a solid ink printer have been described supra. The system disclosed herein includes a solid ink delivery system and a solid ink printer and an ink stick for incorporating the same. A monochrome version of this printer might have multiple channels of black ink or may have various shades of gray, white or neutral in addition to black. The configuration shown and described is a four color configuration but this could be six colors or any other practical number, including multiple channels of one or more specific colors. Imaging might be on surfaces atypical of normal printing on media, such as directly on products or packaging materials.

Figure 1:
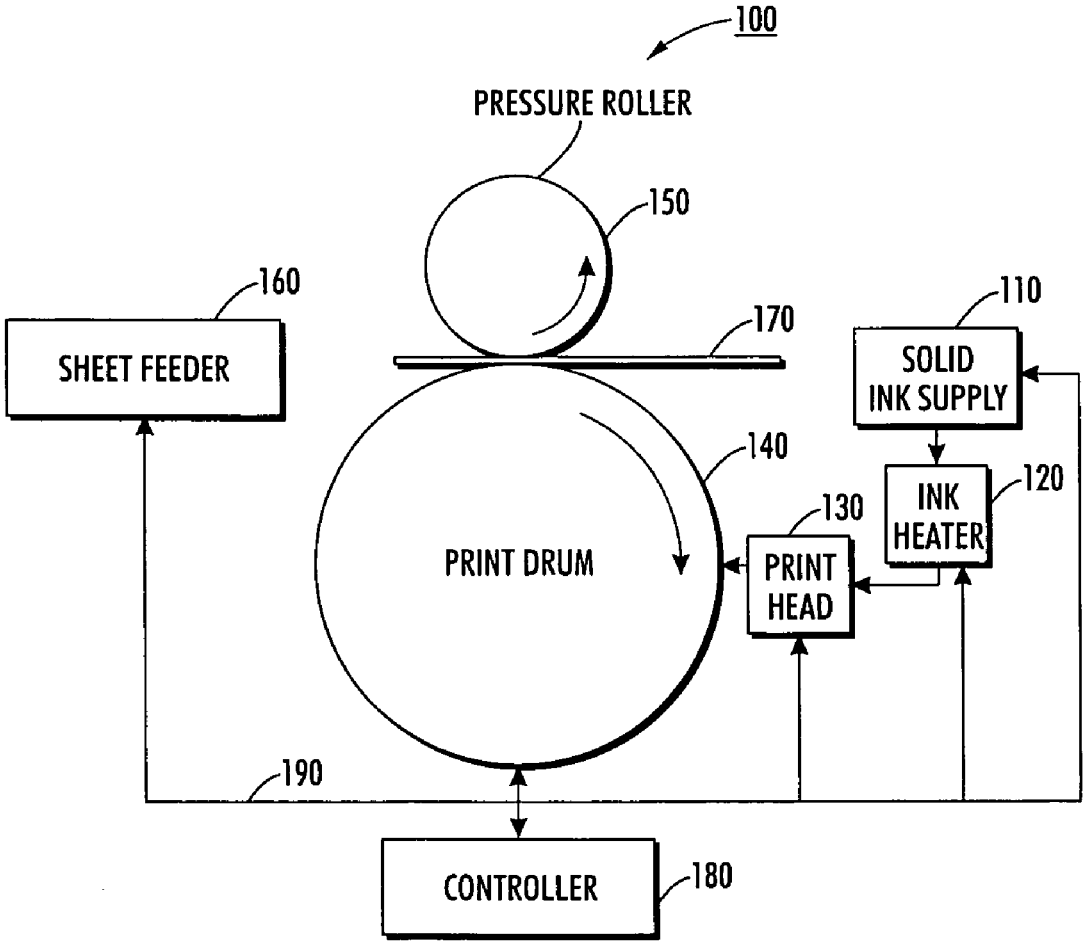
FIG. 1 PRIOR ART
FIG. 1 is a general schematic diagram of a prior art high speed, solid ink printer.
Figure 2:
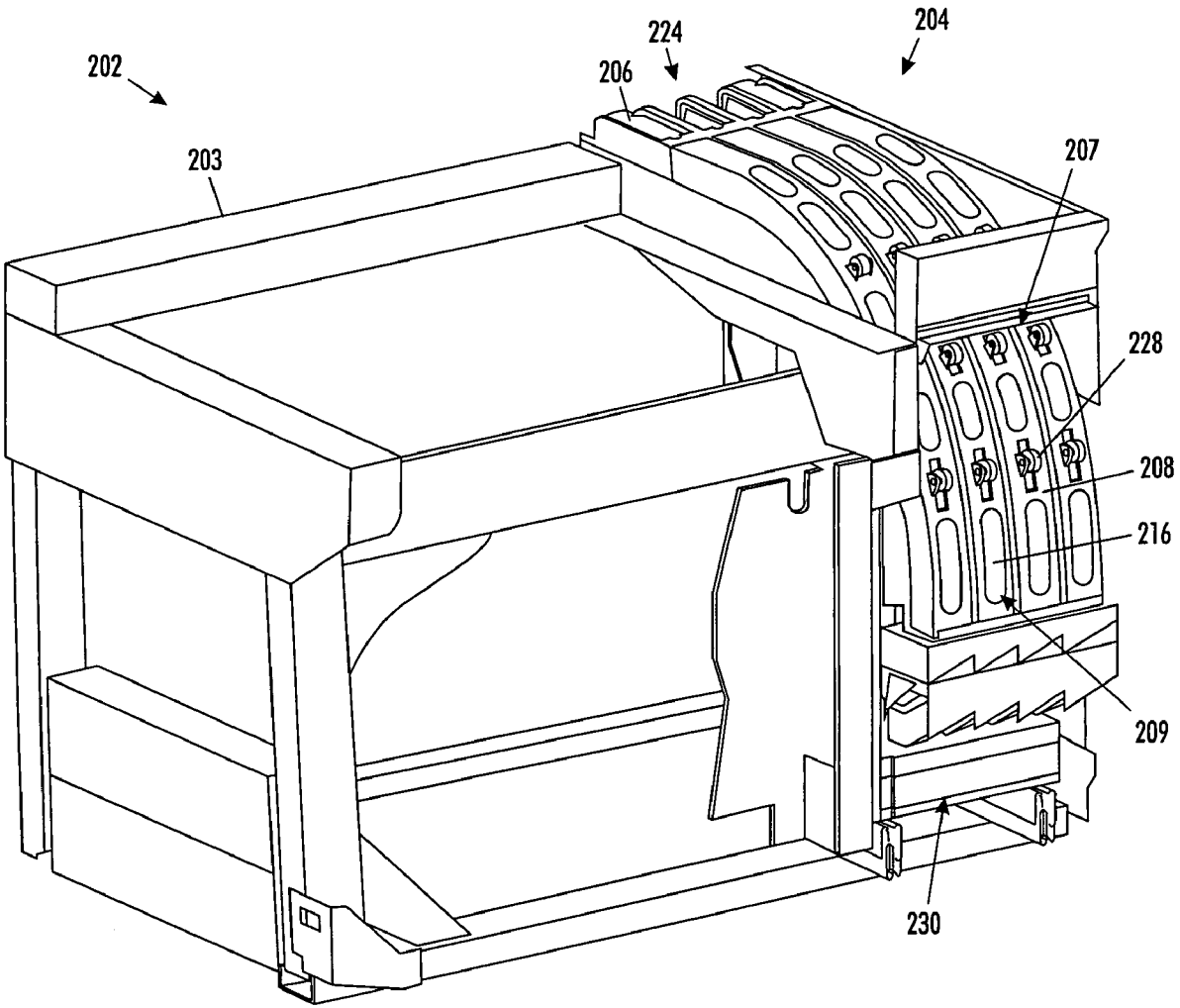
FIG. 2 is a cutaway perspective view of an embodiment of a currently disclosed solid ink delivery system in position in a solid ink printer for delivering ink sticks to printheads of the solid ink printer.

According to the system disclosed herein and referring now to FIG. 2, an embodiment of the solid ink printer with the solid ink delivery system of the system disclosed herein is shown as printer 202. The printer 202 is a multi-color printer. The printer 202 utilizes four separate color ink sticks 206 which have respectively the colors black, cyan, magenta and yellow. The printer 202 of FIG. 2 also has a chute 208 that includes an arcuate portion 207 to increase the stick capacity of the chute 208. The arcuate portion may be comprised of a single or multiple arc axes, including continuously variable 3 dimensional arc paths, any combination of which can be of any length relative to the full arcuate portion. The term arcuate refers to these and any similar, non linear configuration. A monochrome version of this printer might have multiple channels of black ink or may have various shades of gray, white or neutral in addition to black. The configuration shown and described is a four color configuration but this could be six colors or any other practical number, including multiple channels of one or more specific colors. Imaging might be on surfaces atypical of normal printing on or transfer to media, such as directly on products or packaging materials.

The printer 202, as shown in FIG. 2, has a frame 203 which is used to support the solid ink delivery system 204. The solid ink delivery system 204 advances the sticks 206 from loading station 224 near the top of the solid ink printer 202 to melting station 230 near the bottom of the printer 202. The printer 202 includes a plurality of chutes 208. A separate chute 208 is utilized for each of the four colors: namely cyan, magenta, black and yellow. Color order mentioned here and elsewhere is not necessarily representative of the product and for the purpose of the system disclosed herein, is not significant.

As shown in FIG. 2, the chutes 208 may include longitudinal openings 209 for viewing the progress of the sticks 206 within the chutes 208 and also to reduce cost and weight. Nudging members 228 may be positioned along the chute 208 for nudging the sticks 206 against belt 216.

Figure 3:
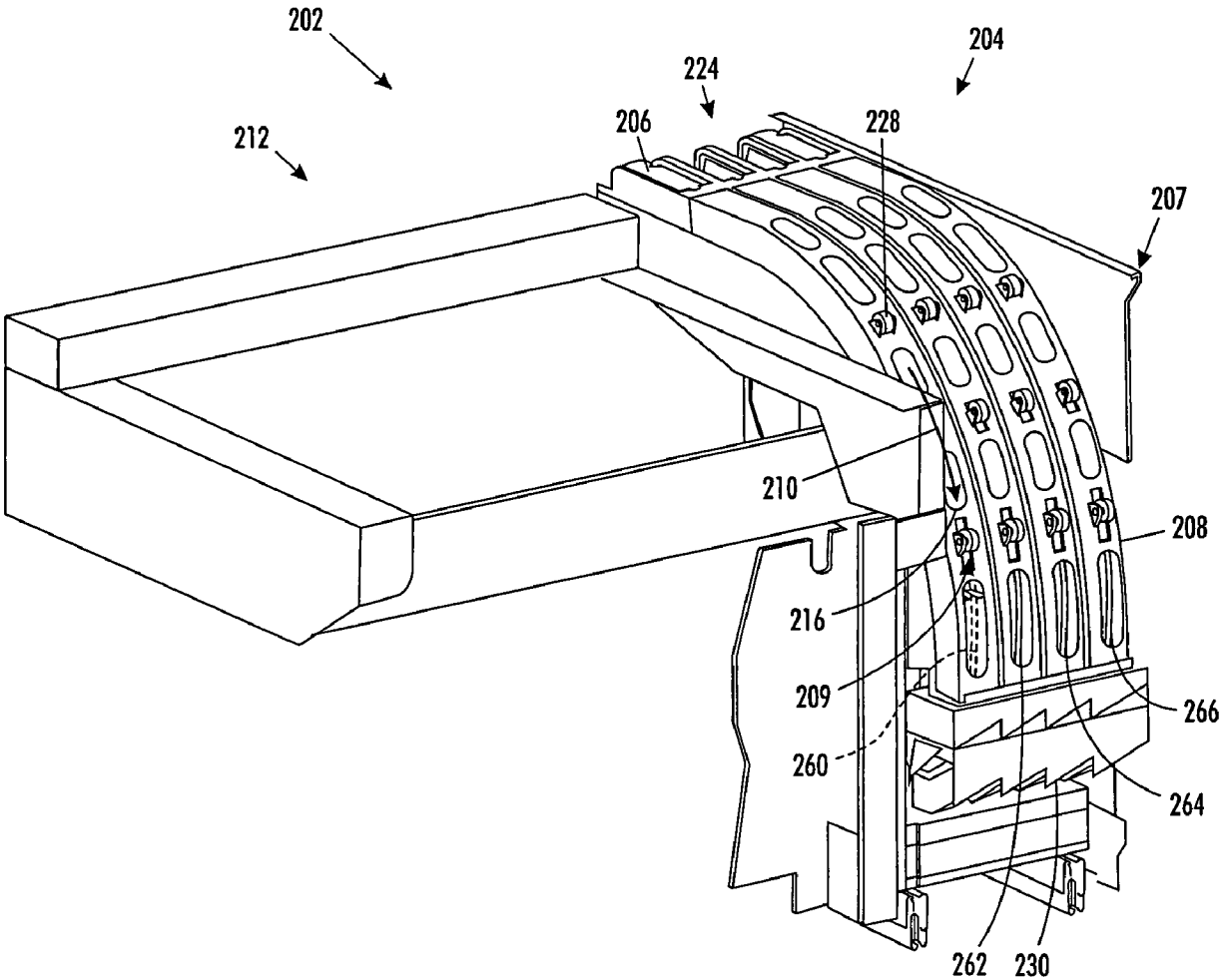
FIG. 3 is a partial cutaway perspective view of the currently disclosed solid ink delivery system of FIG. 2 in position in a solid ink printer for delivering ink sticks to printheads of the printer, showing the ink delivery system in greater detail.
Figure 4:
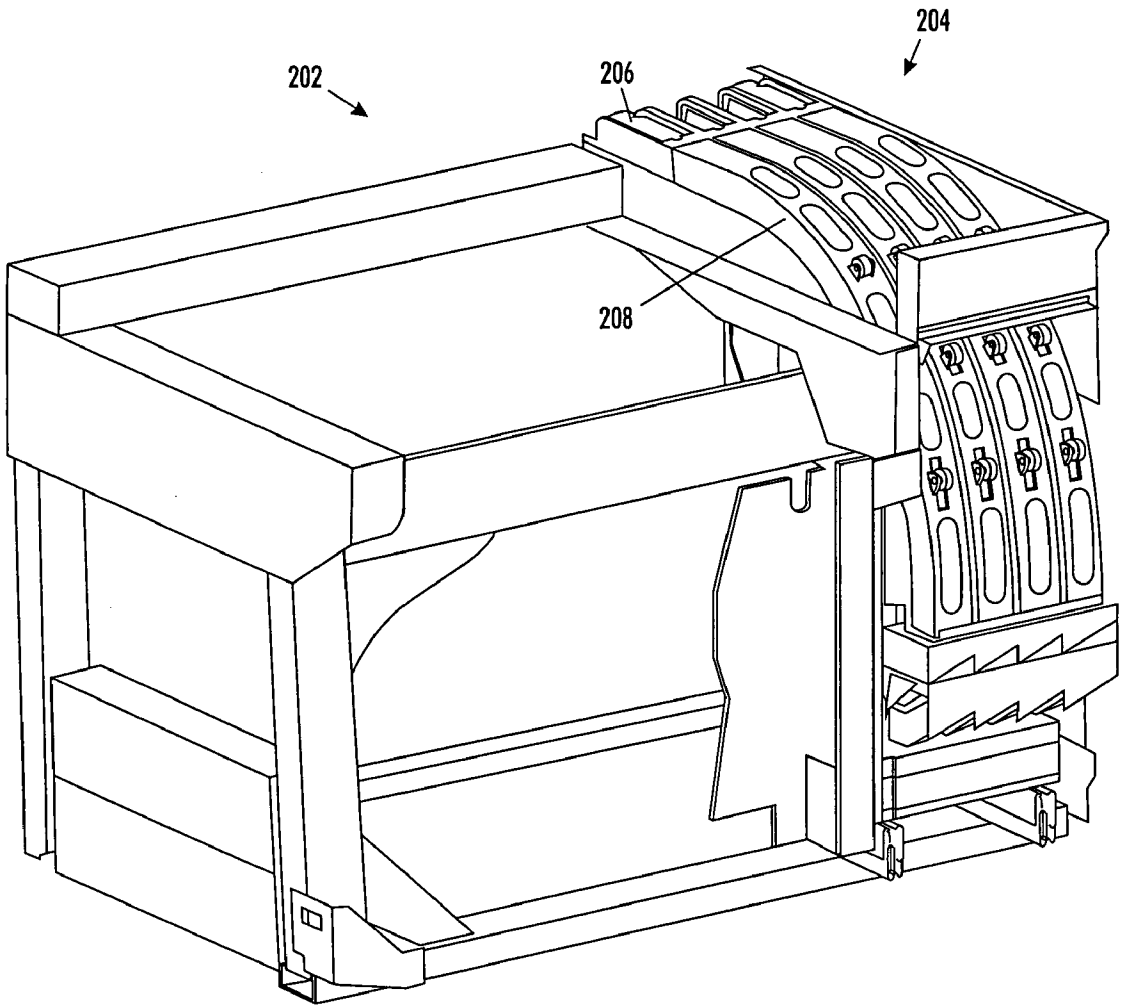
FIG. 4 is a perspective view of the guide for the ink sticks of the currently disclosed solid ink delivery system of FIG. 2 in position in a solid ink printer for delivering ink sticks to printheads of the printer.

Referring now to FIGS. 3 and 4, the solid ink delivery system 204 of the printer 202 is shown in greater detail. The solid ink delivery system 204 incorporates separate solid ink delivery sub-systems, each consisting, in part, of a load or receiving section, a feed chute and a melt unit. For example, and as is shown in FIGS. 3 and 4, solid ink delivery system 204 includes a black ink delivery sub-system 260.

The solid ink delivery system 204 further includes a second, third and fourth solid ink delivery sub-system 262, 264 and 266 providing for cyan, yellow and magenta ink sticks respectively. The colors have been described in a specific sequence but may be sequenced in any order for a particular printer. Keyed insertion openings define which color will be admitted into a sub-system color chute of the solid ink delivery system 304. Each of the solid ink delivery sub-systems 260, 262, 264 and 266 may be positioned parallel to each other and may have similar components. For simplicity, the black solid ink delivery sub-system 260 will be described in greater detail. It should be appreciated that the other sub-systems 262, 264 and 266 have similar components and operate similarly to the black solid ink delivery sub-system 260.

The black solid ink delivery sub-system 260 includes the guide in the form of chute 208 for holding a number of ink sticks 206 and guiding them in a prescribed path 210 from loading station 224 to the melting station 230. The chute 208 may have an insertion opening with any suitable shape such that only one color of an ink stick set may pass through the opening. The black solid ink delivery sub-system 260 further includes a drive member in the form of belt 216 which provides for simultaneous engagement with a plurality of the ink sticks 206 and extends along a substantial portion of the prescribed path 210 of the solid ink delivery sub-system 260.

Figure 5:
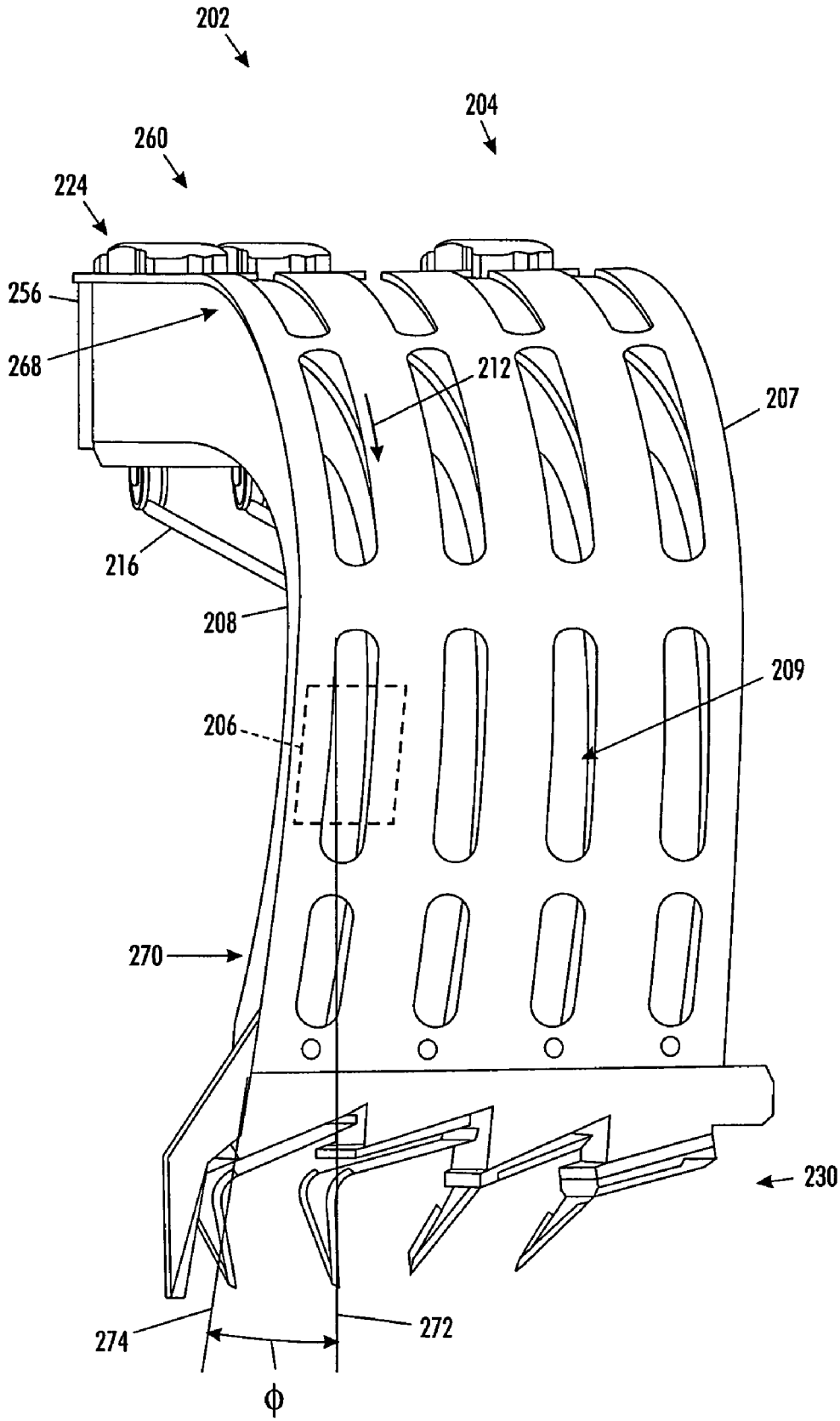
FIG. 5 is another perspective view of the currently disclosed solid ink delivery system of FIG. 2 for advancing the ink sticks of the currently disclosed solid ink delivery system toward the printheads of the printer.
Figure 6:
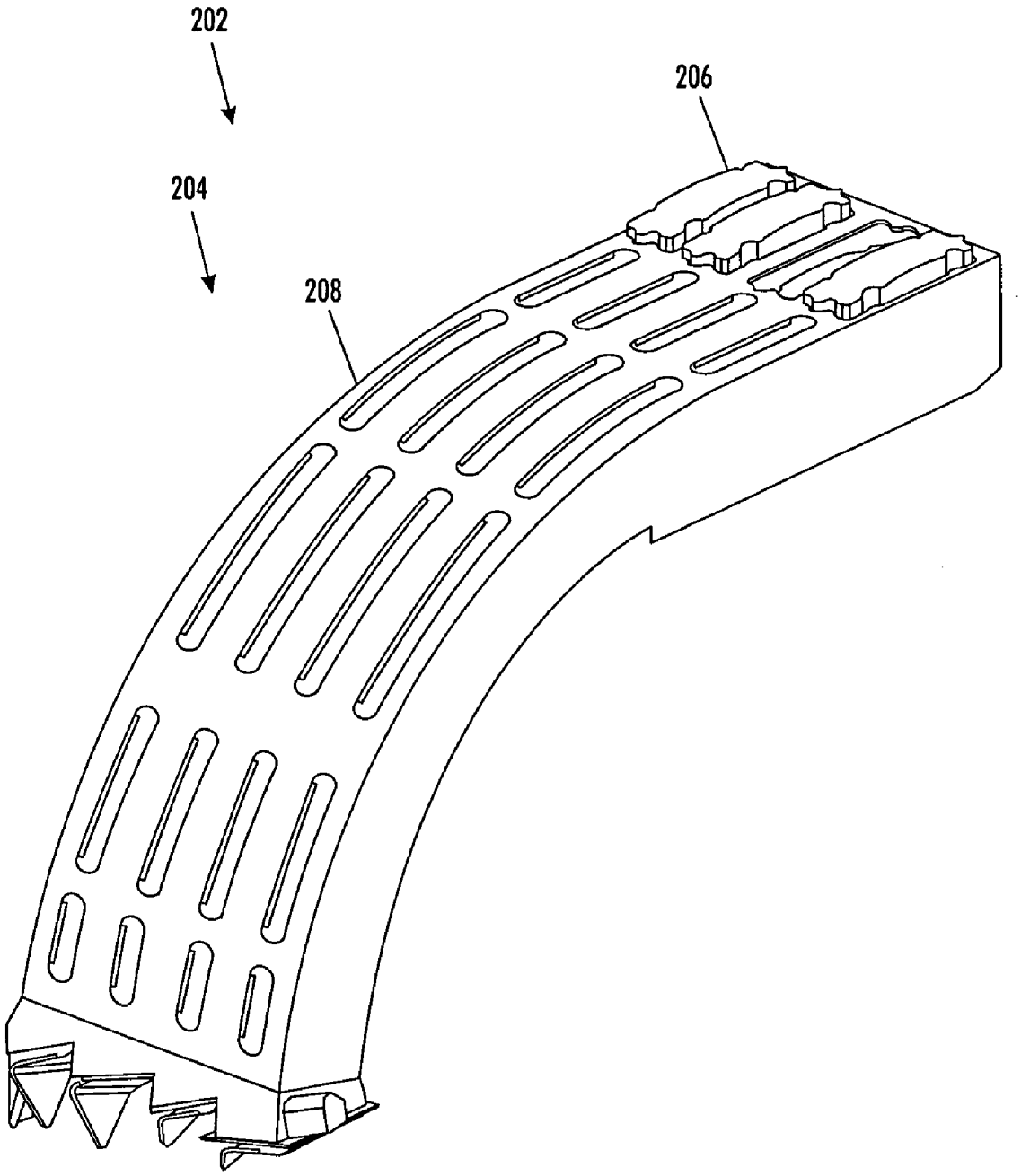
FIG. 6 is another perspective view of the guide assembly of the currently disclosed solid ink delivery system of FIG. 2 for advancing the ink sticks of the currently disclosed solid ink delivery system toward the printheads of the printer.

While the chute 208 may have any suitable shape, for example, and as shown in FIGS. 5 and 6, the chute 208 may include a first linear portion 268 adjacent the loading station 224. As shown in FIGS. 5 and 6, the first linear portion 268 may be substantially horizontal such that the ink stick 206 may be inserted into the end 256 of the chute 208 in a simple horizontal motion in the top of the printer 202 or the stick may be inserted vertically through a keying feature (not shown) into the chute and then advanced horizontally.

To better utilize the space within the printer 202, the chute 208 may have a shape that is not linear such that a greater number of ink sticks 206 may be placed within the printer 202 than the number possible with a linear chute limited in length by available space. For example, and as shown in FIGS. 5 and 6, the chute 208 may include, in addition to the first linear portion 268, arcuate portion 207 extending downwardly from the first linear portion 268 of the chute 208. The chute 208 may further include a second linear portion 270 extending downwardly from the arcuate portion 207 of the chute 208. The second linear portion 270 may be substantially vertical and be positioned over the melting station 230 such that the ink sticks 206 may be delivered to the melting station 230 by gravity.

The chute may lay within a single plane, for example, plane 272. Alternatively, and as shown in FIGS. 5 and 6, the chute 208 may extend through a series of non-parallel planes. For example, and as shown in FIG. 5, the chute 208 may move downwardly and outwardly to an angled plane 274 which is skewed with respect to the vertical plane 272. The planes 272 and 274 form an angle $\phi$ there between. The angle $\phi$ may be any angle capable of providing for a larger number of ink sticks 206 in chute 208.

Figure 7:
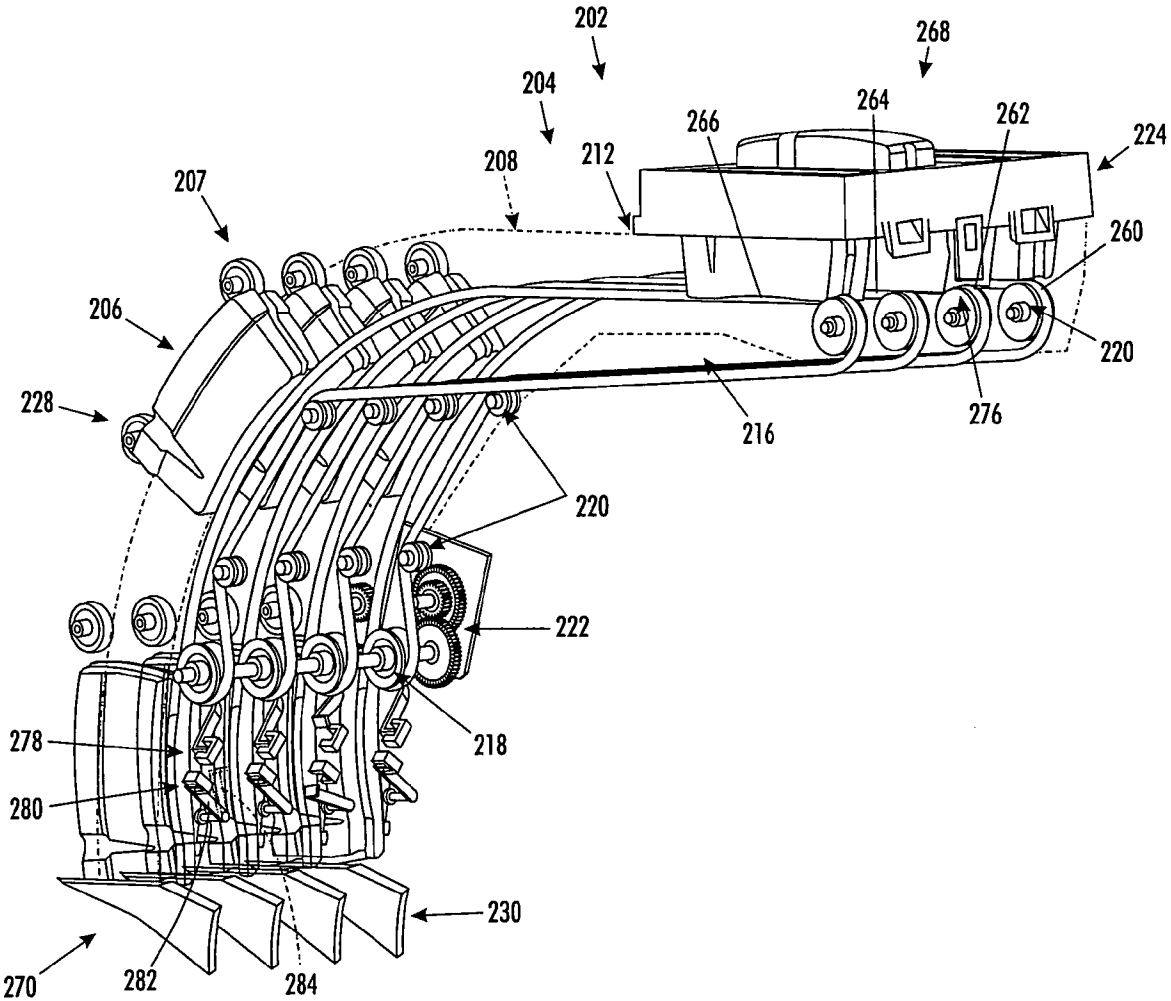
FIG. 7 is another perspective view of the guide assembly of the currently disclosed solid ink delivery system of FIG. 2 including the drive member for advancing the ink sticks of the currently disclosed solid ink delivery system toward the printheads of the printer.

Referring now to FIG. 7, the drive belt 216 of the solid ink delivery system 204 of the printer 202 is shown in greater detail. The drive belt 216 may require that a portion of the belt 216 have a shape to conform to the chute 208. The conforming shape may be in the arcuate portion 207 of the chute 208, as well as in the first linear portion 268 and the second linear portion 270 of the chute 208. The belt 216 may be driven, for example, by a motor transmission assembly 222 which is used to rotate drive pulley 218.

The drive belt 216 may for example have a circular cross section and be a continuous belt extending from the drive pulley 218 through a series of inlet idler pulleys 220 and chute 208. Nudging members 228 in the form of, for example, pinch rollers may be spring loaded and biased toward the belt 216 to assure sufficient friction between the belt 216 and the ink sticks 206 such that the ink sticks do not feed by gravity and slip away from the belt 216.

The solid ink delivery system 204 of the printer 202 may further include a series of sensors for determining the presence or absence of the ink sticks 206 within different portions of the chute 208. An inlet sensor assembly 276 may be used to indicate that additional ink sticks 206 may be added to the chute 208 when a previously inserted stick is advanced sufficiently. The inlet sensor assembly 276 may be positioned near loading station 224. A low sensor assembly 278 may be used to indicate a low quantity of ink sticks 206 in the chute 208. The low sensor assembly 278 may be positioned spaced from the melting station 230.

An out sensor assembly 280 may be used to indicate the absence of ink sticks 206 in the chute 208, excepting any remaining unmeltable ink volume. The out sensor assembly 280 may be positioned adjacent to the melting station 230. The sensor assemblies 276, 278 and 280 may have any suitable shape and may, for example, and as is shown in FIG. 6, be in the form of pivoting flags or sensors that pivot about a wall of the chute 208 and transition a switch, such as a micro switch or an optical interrupter. The presence of a stick 206 causes the sensors to move from first position 282, as shown in phantom, to second position 284, as shown in solid. A sensor or switch may be used to determine whether the sensors 276, 278 or 280 are in the first position 282 or in the second position 284. Other sensing devices may be used in conjunction with or in place of a mechanical flag system, such as a proximity switch or reflective or retro-reflective optical sensor.

Figure 8:
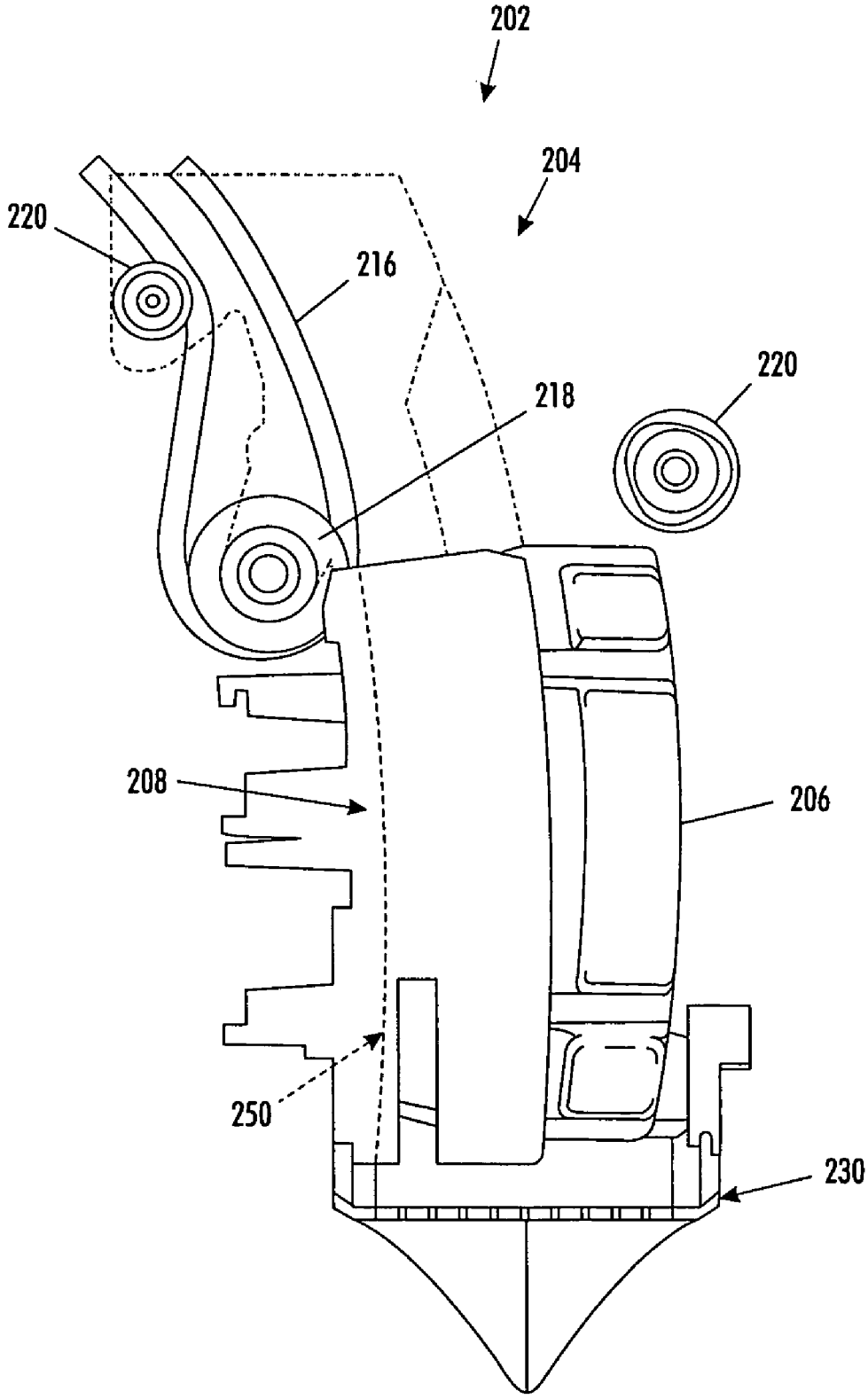
FIG. 8 is partial perspective view of the guide assembly including the drive member for advancing the ink sticks of the currently disclosed solid ink delivery system of FIG. 2 showing the portion adjacent the print heads in greater detail.

Referring now to FIG. 8, the solid ink delivery system 204 of the printer 202 is shown in the location around the melting station 230. As shown in FIG. 8, the drive pulley 218 and the belt 216 are positioned somewhat away from the ink stick 206 when the ink stick 206 is in the melting station 230. The spacing of the belt 216 away from the ink stick 206 when the ink stick 206 is in the melting station 230 may permit gravity to be the only factor causing the ink sticks 206 to be forced against a melt unit when the belt is stopped. If the belt 216 continues to run, however, additional sticks 206, if present, may contact the belt 216 and push against the lower stick 206, urging it toward the melting station 230.

It should be appreciated that, alternatively, the pulley 218 may be positioned low enough that the ink stick 206 may be in contact with the belt in the pulley 218 area when the stick 206 is in the melting station 230. With such configuration, the belt 216 may insure sufficient forces are exerted on the ink stick 206 to increase the contact pressure of the ink stick 206 against the melt unit.

Figure 9:
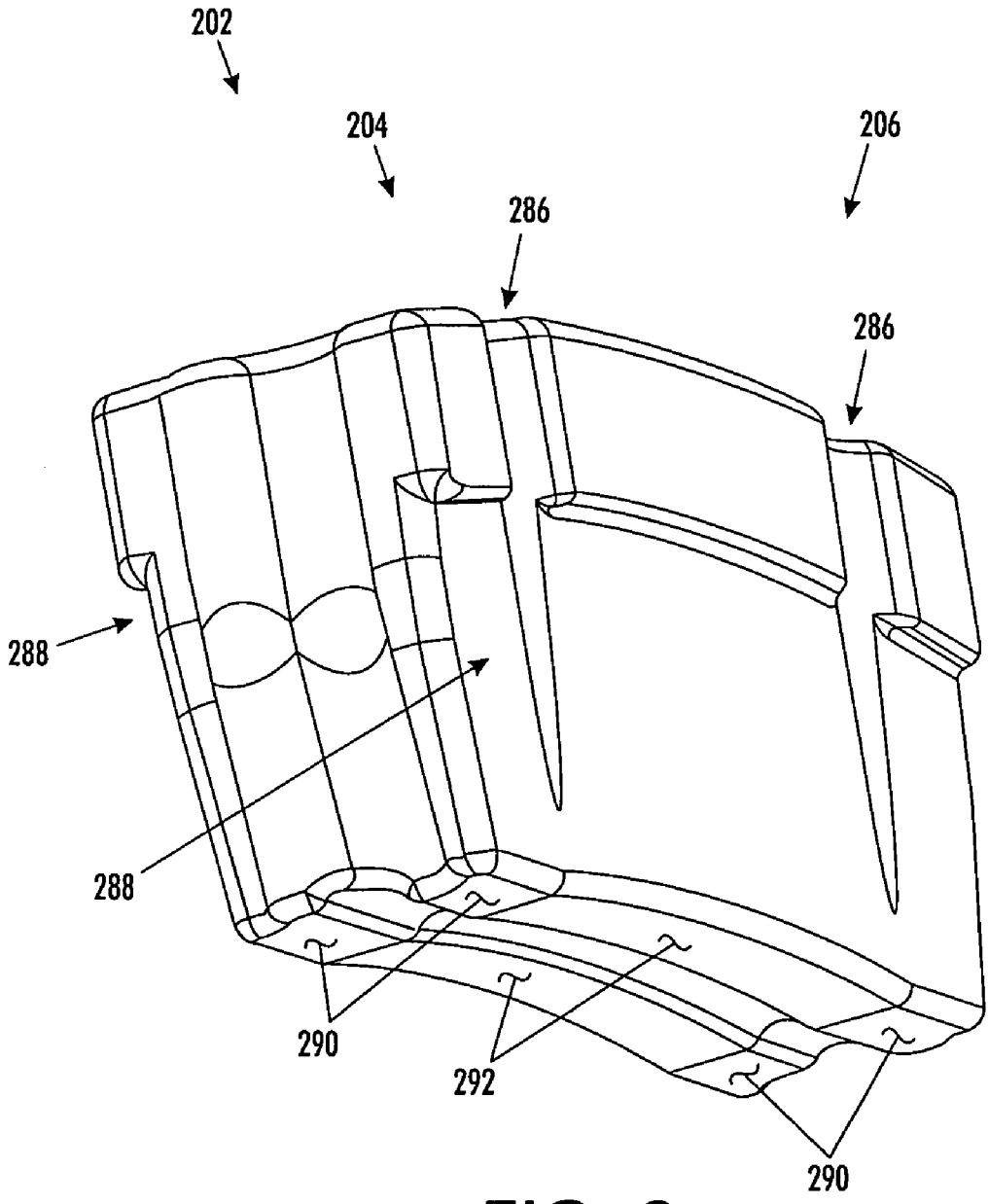
FIG. 9 is a perspective view of an ink stick for use with the guide assembly for advancing the ink sticks of the currently disclosed solid ink delivery system of FIG. 2 toward the print heads of the printer.

Referring now to FIG. 9, ink stick 206 for use with the printer 202 of FIGS. 2-8 is shown in greater detail. The ink stick 206 as shown in FIG. 9 includes a series of vertical keying features used, among other things, to differentiate sticks of different colors and different printer models. The stick keying features are used to admit or block insertion of the ink through the keyed insertion opening of the solid ink delivery system 304. The ink stick 206 further includes a series of horizontal shaped features 288 for guiding, supporting or limiting feed of the ink stick 206 along the chute feed path. It should be appreciated that that keying and shaped features can be configured to accomplish the same functions with a horizontal or other chute or alternate loading orientation.

The ink stick 206, as shown in FIG. 9, includes two spaced-apart pairs of spaced-apart nominally flat underside portions 290, one pair on each end of the stick 206, for accommodating the linear portions of the feed path, as well as a centrally located pair of spaced apart arcuate portions 292, to accommodate the curved or arcuate portion of the ink feed path. Ink stick groove 250 which separates the pairs, likewise has linear and arcuate portions.

Figure 10:
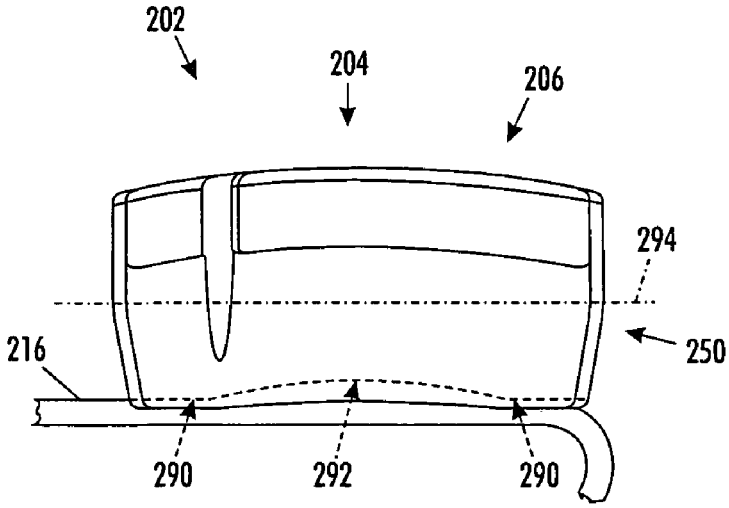
FIG. 10 is a plan view of the ink stick of FIG. 9 in position on a flat portion of the drive member of FIG. 7.

Referring now to FIG. 10, the ink stick 206 is shown in position on a linear portion of the belt 216 of the solid ink delivery system 204 of the printer 202. The ink stick 206 contacts the belt 216 at the flat end portions 290 of the ink stick 206 and the groove 250 formed in the ink stick 206 cooperates with the belt 216 to influence position and advance the stick 206.

Figure 11:
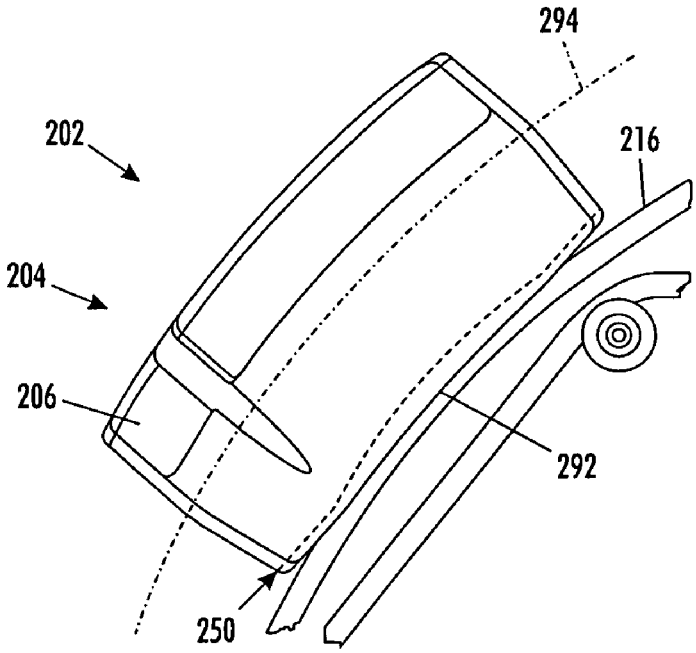
FIG. 11 is an plan view of the ink stick of FIG. 9 in position on a curved portion of the drive member of the delivery system of FIG. 7.

Referring to FIG. 11, the ink stick 206 is shown in position along an arcuate portion of the belt 216. As shown in FIG. 11, the central arcuate portion 292 of the ink stick 206 engages with the belt 216. The ink stick 206 is arcuate or curved along longitudinal axis 294.

Figure 12:
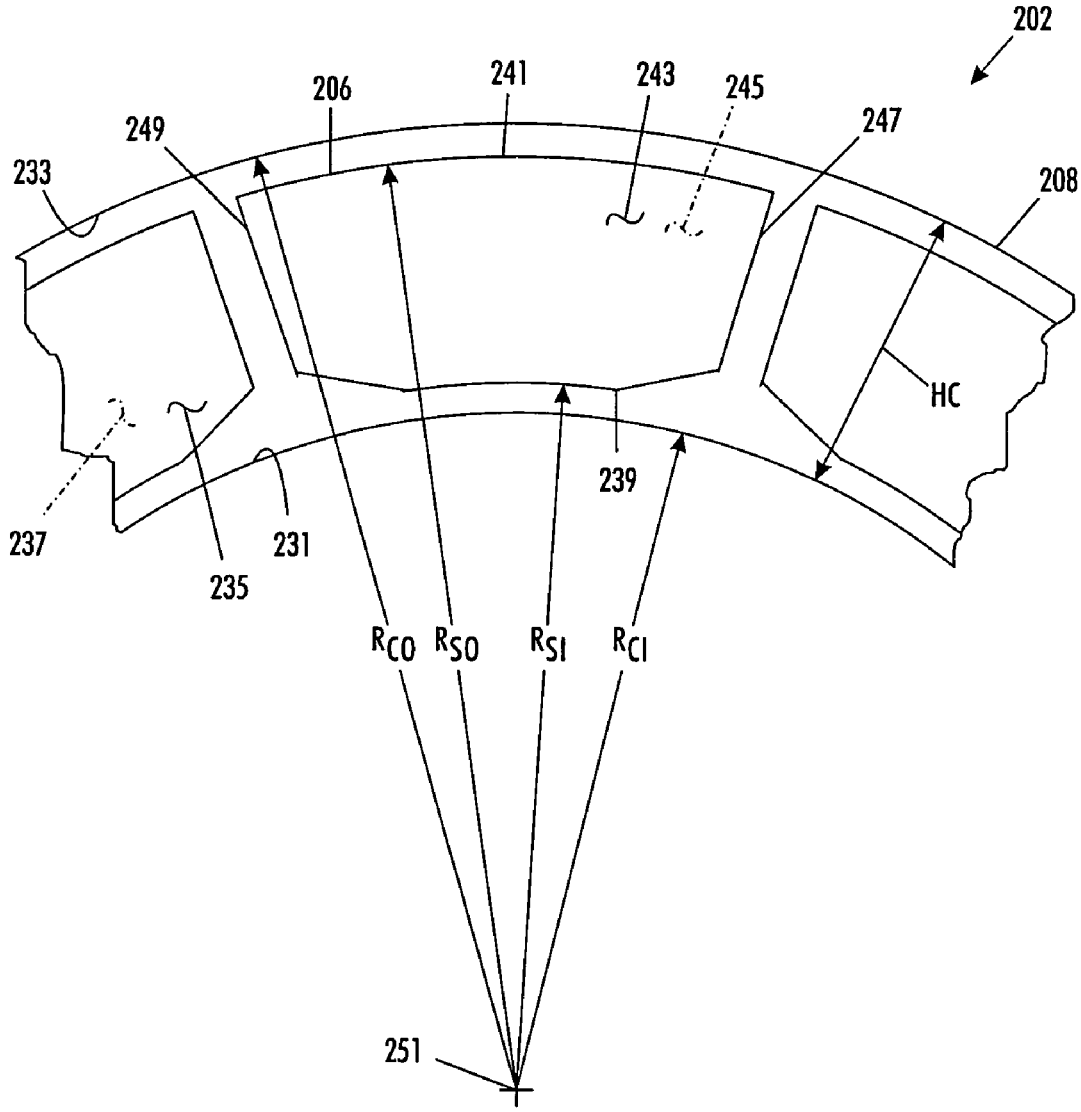
FIG. 12 is a partial plan view, partially in cross section, of the ink stick and chute of the arcuate portion of the solid ink delivery system of FIG. 7.

According to the system disclosed herein and referring now to FIG. 12, the chute 208 of the ink delivery system 204 of the ink printer 202 is shown in greater detail. As shown in FIG. 12, the arcuate portion 207 of the chute 208 is shown in cross-section with sticks 206 shown in the chute 208. The chute 208 includes a first chute internal surface 231 and an opposed second chute internal surface 233. It should be appreciated that the chute 208 may also include a third chute internal surface 235 as well as a fourth chute internal surface 237. The four chute internal surfaces, 231, 233, 235, and 237 form the internal periphery 232 of the chute 208. According to the system disclosed herein, the sticks 206 are adapted to fit with the internal periphery 232 of the chute 208 such that the sticks 206 may move more smoothly and efficiently than if the sticks 206 were to have their traditional, strictly rectangular shape. As shown in FIG. 12, the stick 206 includes a first stick external surface 239 and an opposed second stick external surface 241. It should be appreciated that the stick 206 may include a third stick external surface 243 and an opposed fourth stick external surface 245. It should be further appreciated that the ends of the stick 206 may define a fifth stick external surface 247 and a sixth stick external surface 249. It should be appreciated that conformity of the chute to the stick need not be completely around the stick or for the entire length of the chute, but only need be sufficient for proper guidance of the stick through the chute According to the system disclosed herein, the ink stick 206 is provided such that, for example, the first stick external surface 239 or the second stick external surface 241 is curved or arcuate. Alternatively and as shown in FIG. 12, both the first stick external surface 239 and the second stick external surface 241 may be arcuate or curved. The curved surfaces of the stick may be concave or convex or a combination of concave, convex, and planar.

For example, and as shown in FIG. 12, the first stick external surface 239 may be concave and the second stick external surface 241 may be convex. As shown in FIG. 12 and to provide to for a closely conforming stick 206 to smoothly flow through the chute 208, the first chute internal surface 231 may conform to the first stick external surface 239. For example and as shown in FIG. 12, the first stick external surface 239 may be concave with the first chute internal surface 231 being convex. Similarly, and as shown in FIG. 12, the second chute internal surface 233 may have a concave shape to conform with the convex shape of second stick external surface 241.

If, as shown in FIG. 12, the chute 208 has a first chute internal surface 231 and a second chute internal surface 233 that are described by arcs of a circle, the first stick external surface 239 and the second stick external surface 241 may, likewise, be described by arcs are portions of a circle. Such similar shapes between the surfaces of the chute 208 and those of the stick 206 may provide for a closely conforming stick 206 within chute 208 to alleviate problems of camming, jamming, or sticking of the stick 206 within the chute 208.

For example, for simplicity and as shown in FIG. 12, the first chute internal surface 231 may be defined by radius $R_{CI}$ extending from origin 251. Similarly, the second chute internal surface may be defined by radius $R_{CO}$ extending from origin 251. By providing a chute 208 with the first chute internal surface 231 defined by radius $R_{CI}$ and a second chute internal surface 233 defined by radius $R_{CO}$ the height HC of the chute remains a constant. By having a chute with a constant height HC, a stick may have complementary heights at various locations along its length, allowing a radius of curvature that is not uniform or that changes transversely.

Figure 12A:
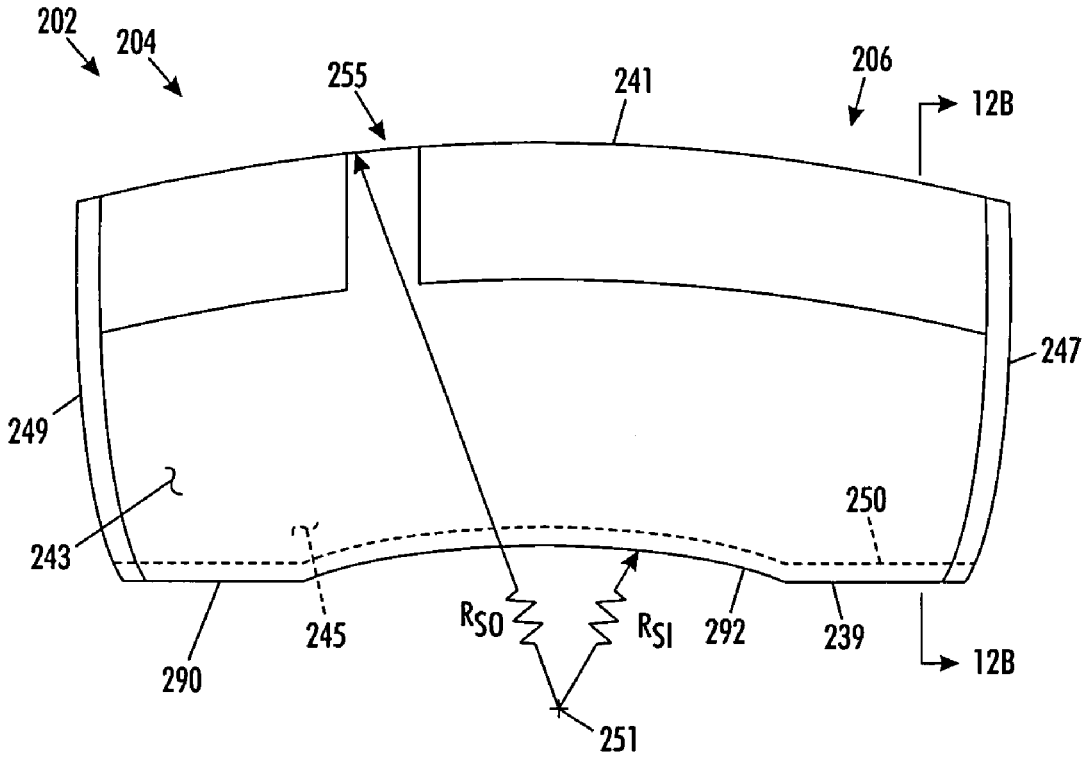
FIG. 12A is an plan view of the ink stick of FIG. 9.
Figure 12B:
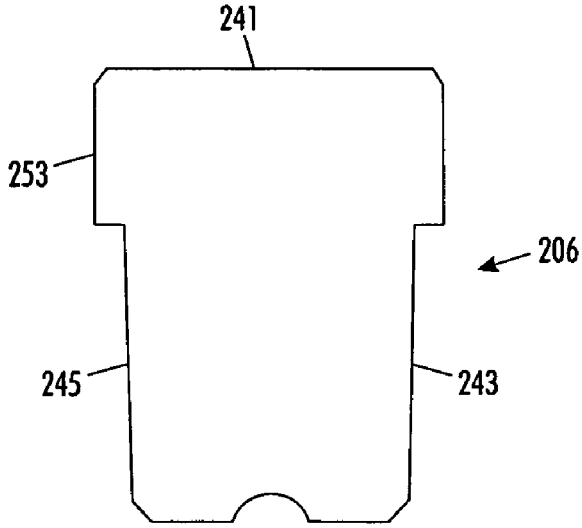
FIG. 12B is a cross sectional view of FIG. 12A along the line 12B-12B in the direction of the arrows.

Referring now to FIGS. 12A and 12B, the stick 206 for use in the solid ink delivery system 204 of the solid ink printer 202 is shown in great detail. As shown in FIG. 12A, the stick 206 includes opposed first stick external surface 239 and second stick external surface 241. The second stick external surface 241 is defined by radius $R_{SO}$ extending from origin 251. To accommodate the linear and non-linear portions of chute 208, the first stick external surface 239 includes an arcuate portion 292 as well as opposed linear portions 290. The arcuate portion 292 is defined by radius $R_{SI}$ extending from origin 251. The linear portions 290 engage the chute when the stick 206 is in the linear portion of the chute while the arcuate portion 292 of the first stick external surface 239 engages the chute when the stick 206 is in the arcuate portion 207 of the chute 208.

The third surface 243 and the fourth surface 245 may, as shown in FIGS. 12A, 12B, include opposed protrusions 253. The protrusions 253 may conform with similar features (not shown) on the chute 208. The protrusions 253 further provide for the ability to add keying features 255 to the stick 206. The keying feature 255 is utilized to assure that the proper ink stick 206 is positioned in the proper chute 208 of the solid ink delivery system 204 of the printer 202.

The fifth stick external surface 247 and the sixth stick external surface 249 may, as shown in FIG. 12A, have a shape other than planar or linear. For example, the surfaces 247 and 249 may be arcuate. For example and as shown in FIG. 12A, the fifth stick external surface 247 and the sixth stick external surface 249 are convex. The convex shape of the fifth stick external surface 247 and the sixth stick external surface 249 permits for smooth transitioning of contact of the adjoining sticks 206 when transitioning between a linear portion of the chute 208 and the arcuate portion 207 of the chute 208.

The sticks 206 may include a groove 250 for cooperation with the belt 216. The groove 250 may be positioned in both the linear portion 247 and arcuate portion 292 of the first stick external surface 239. The linear portions of the groove 250 are utilized when the stick 206 is in a linear portion of the chute 208 while the arcuate portion of the groove 250 is utilized when the stick 206 is in arcuate portion 207 of the chute 208. Multiple belts may be used and may cover only a portion of the full travel path in any one or more of linear and/or arcuate portions of the chute.

Figure 12C:
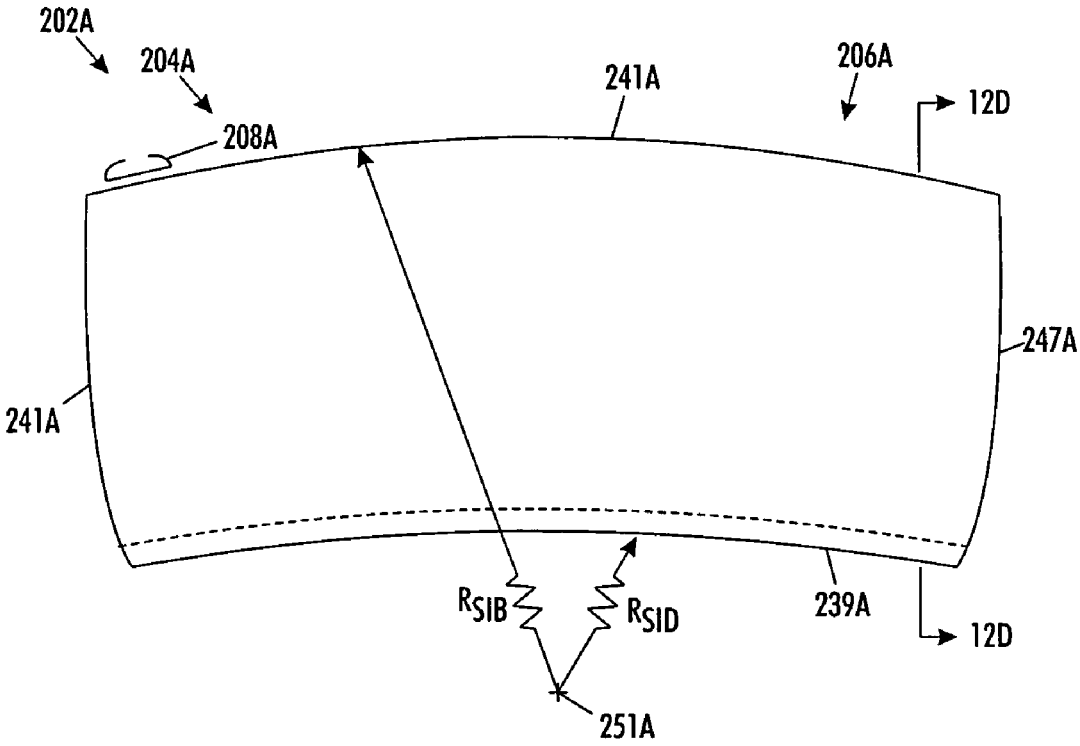
FIG. 12C is an plan view of an alternative ink stick according to the system disclosed herein.
Figure 12D:
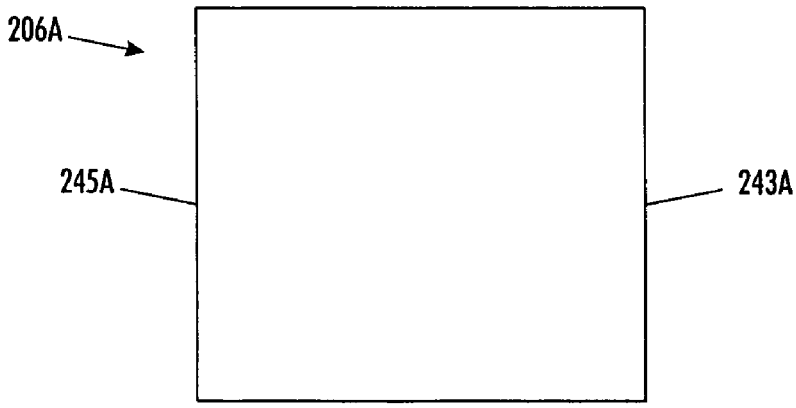
FIG. 12D is a cross sectional view of FIG. 12C along the line 12D-12D in the direction of the arrows.

Referring now to FIGS. 12C and 12D, yet another embodiment of the system disclosed herein is shown as stick 206A for use in solid ink delivery system 204A in solid ink printer 202B. The solid ink printer 202A is similar to the solid ink printer 202 of FIGS. 1-12 except that the chute 208A of solid ink delivery system 204A has a simple rectangular cross-section rather than the more complex cross-section of the solid ink delivery system 204 of FIGS. 1-12. The solid ink delivery system 204A utilizes the ink stick 206A.

The solid ink stick 206A includes a first solid ink external surface 239A which is defined by radius $R_{SID}$ extending from origin 251A. Similarly, the second stick external surface 241A is defined by radius $R_{SIB}$ extending from origin 251A. The ink stick 206A further includes third stick external surface 243A and fourth ink stick external surface 245A. The third ink external surface 243A and the fourth ink stick external surface 245A are flat or planar. The ink stick 206A further includes a fifth ink stick external surface 247A that is convex as well as a sixth ink external surface 249A that is also convex.

Figure 13:
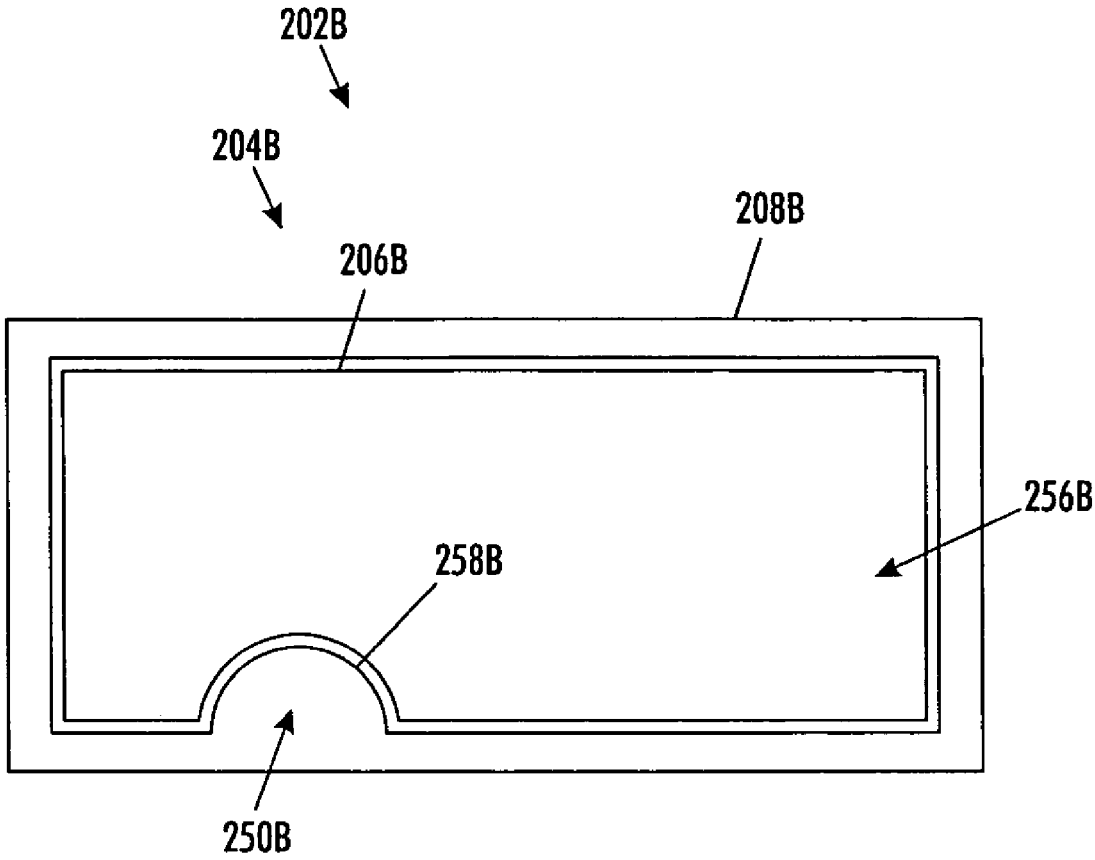
FIG. 13 is a plan view, partially in cross section, of an alternative ink stick according to another embodiment of the system disclosed herein.

Referring now to FIG. 13, yet another embodiment of the system disclosed herein is shown as solid ink printer 202B which utilizes a solid ink delivery system 204B. The solid ink delivery system 204B is similar to the solid ink system 204 of FIGS. 2-8 except that the solid ink delivery system 204B includes a ink stick 206B which has a stick belt guide 250B which is not central within the stick 206B. End 256B of guide 208B includes a key 258B which likewise is not central such that the stick 206B matches the key 258B.

Figure 14:
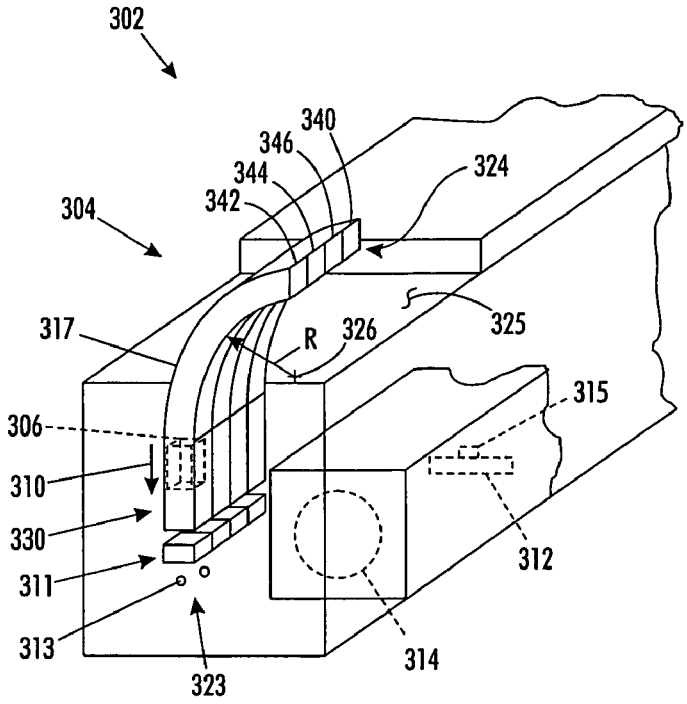
FIG. 14 is a partial perspective view of another embodiment of a currently disclosed solid ink delivery system for delivering solid ink stock to a melting station of a printer for converting the solid ink into liquid form for delivery to print heads of the printer.

According to the system disclosed herein and referring now to FIG. 14, a solid ink printer 302 is shown. The printer 302 includes a solid ink delivery system 304 for use with a ink stick 306. The printer 302 includes the solid ink delivery system 304 for delivering the ink stick 306 to a melting station 330 where a melting unit 311 is used to melt the ink stick 306. The ink stick 306 is converted from a solid to a liquid and the liquid ink 313 is transferred to media, for example, a sheet of paper 312, by a drum 314 to form an image 315 on the paper 312. The solid ink delivery system 304 includes a guide 317 for guiding the ink stick 306 in a prescribed path 310. The guide 317 may be, for example, in the form of a chute. The guide 317 defines a loading station 324 to permit the ink stick 306 to be placed into the guide or chute 317.

The chute 317 also defines a delivery position 323 adjacent to the melting unit 308. The loading station 324 is located above the delivery position 323. The ink stick 306 is slideably fitted to the chute 317 where by only gravity advances the ink stick 306 through all or any portion of the chute angled to allow gravity to act as the moving force from the loading station 324 to the delivery position 323.

It should be appreciated that the chute 317 may have any suitable shape such that the sticks 306 feeds by gravity, if so oriented, from loading station 324, that may be positioned near, for example, printer top work surface 325, toward the melting unit 311. The chute 317 may include linear and arcuate portions or may, as is shown in FIG. 14, be of a continuous arcuate shape defined by a radius R extending from the origin 326. It should be appreciated that origin 326 may be positioned anywhere with respect to the chute 317 and that the radius R may be constant, or, as is shown in FIG. 14, vary such that the radius R may increase such that the chute is virtually linear and may be vertical near the melting unit 311. It should be obvious that any portion of the chute that has a non constant radius will not have a radius that extends from a single specific origin. This consideration applies to all descriptions and illustrations.

Figure 15:
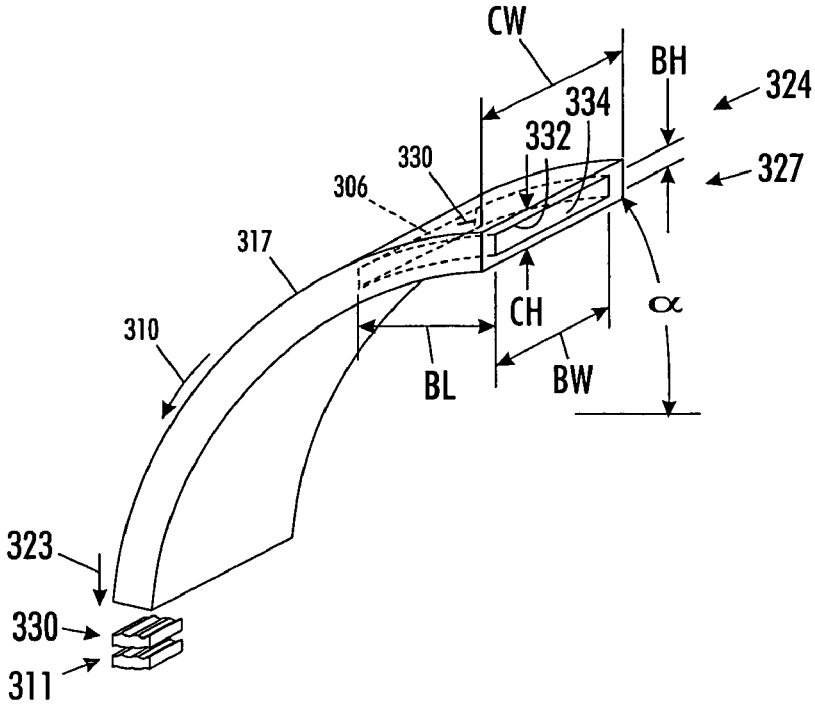
FIG. 15 is a partial perspective view of the chute of the solid ink delivery system of FIG. 14.

Referring now to FIG. 15, it should be appreciated that the chute 317 forms a stick opening 327 in a suitable size and shape and to provide for the uniform movement of the sticks 306 down the chute 317 along the path 310. To avoid cross loading or jamming of the sticks 306 in the chute 317, the sticks 306 may have an external periphery 330 which closely conforms with internal periphery 332 formed in the stick opening 327 of the chute 317 or other panel or plate coupled to the chute. The insertion opening may be parallel, perpendicular or at any intermediate angle relative to any portion of the chute feed path.

Feed of the ink sticks can be entirely influenced by gravity. For example, and as is shown in FIG. 15, the sticks 306 may be rectangular and the stick opening 327 of the chute 317 may be rectangular and slightly larger than the sticks 306 to provide the ability of the sticks 306 to feed by gravity down the chute 317. For example, and as shown in FIG. 15, the sticks have a stick length BL, a stick height BH, and a stick width BW. The stick opening 327 of the chute 317 may be defined by a chute height CH slightly larger than the stick height BH and a chute width CW slightly wider than the stick width BW. In a more ideal configuration, the sticks and insertion opening would include complementary keying features to exclude sticks of the wrong color or intended for a different model.

Further to assure that the sticks 306 feed by gravity down the opening 327 of the chute 317 and as is shown in FIG. 15, the bottom surface 334 of the chute opening 327 may form an angle $\alpha$ with the horizontal plane such that the force of gravity may exceed the coefficient of friction between the sticks 306 and the chute bottom surface 334 such that the sticks advance along the path 310 from the loading station 324 to the delivery position 323. A non-stick surface may be applied to the chute bottom surface 334 to reduce friction. Friction values are not definite and will vary based on numerous factors of a given system, such as stick size, stick to stick interfaces, angle of travel relative to gravity, temperature and so forth.

Referring again to FIG. 14, the printer 302 is a color ink printer. The chute 317 includes a first black chute 340, a second cyan ink chute 342, a third magenta ink chute 344, and a fourth yellow ink chute 346. The four ink chutes 340, 342, 344 and 346 may each have their respective keys to provide for the entry of only the proper ink stick. It should be appreciated that the printer of the system disclosed herein may be a black or mono-chrome printer having a multiple chutes or a solitary chute with gravity feed.

Figure 16:
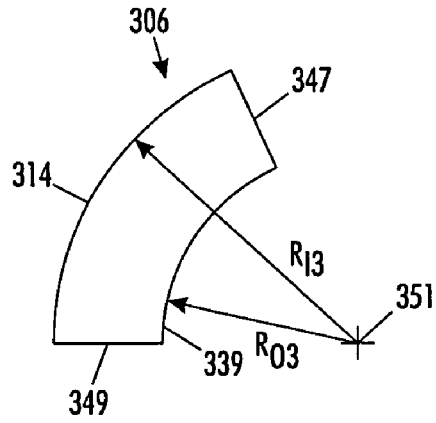
FIG. 16 is an plan view of an alternative ink stick according to the system disclosed herein for use with the printer of FIG. 14.

Referring now to FIGS. 14, 15 and 16, yet another embodiment of the system disclosed herein is shown as ink stick 306. The ink stick 306 is for use in solid ink delivery system 304 of solid ink printer 302. The solid ink printer 302 utilizes the ink stick 306 which may have a simple shape, for example a shape with a square or rectangular cross-section or an arcuate shape.

The ink stick 306 is designed to fit into the chute 308 that has a constantly changing curvature. Thus, the ink stick 306 includes a first external surface 339 defined by radius $R_{I3}$ and an opposed second external ink stick surface 341 that is defined by radius $R_{O3}$ extending from origin 351. The radii $R_{I3}$ and $R_{O3}$ are selected to compromise between the smaller and larger radii in the chute 308. The stick 306 further includes opposed fifth and sixth external surfaces 347 and 349. The fifth and sixth external surfaces 347 and 349 may be slightly convex to provide for contact along the various portions of the chute 308.

Figure 17:
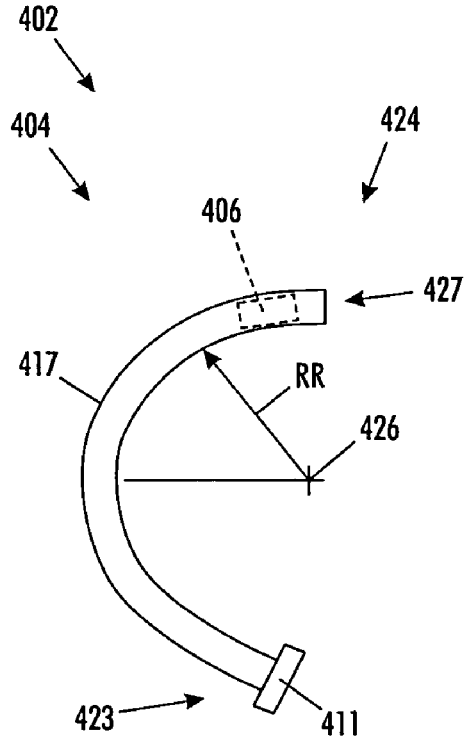
FIG. 17 is a partial plan view of another embodiment of the solid ink delivery system of the system disclosed herein with a chute that has a portion that extends underneath another portion of the chute.
Figure 18:
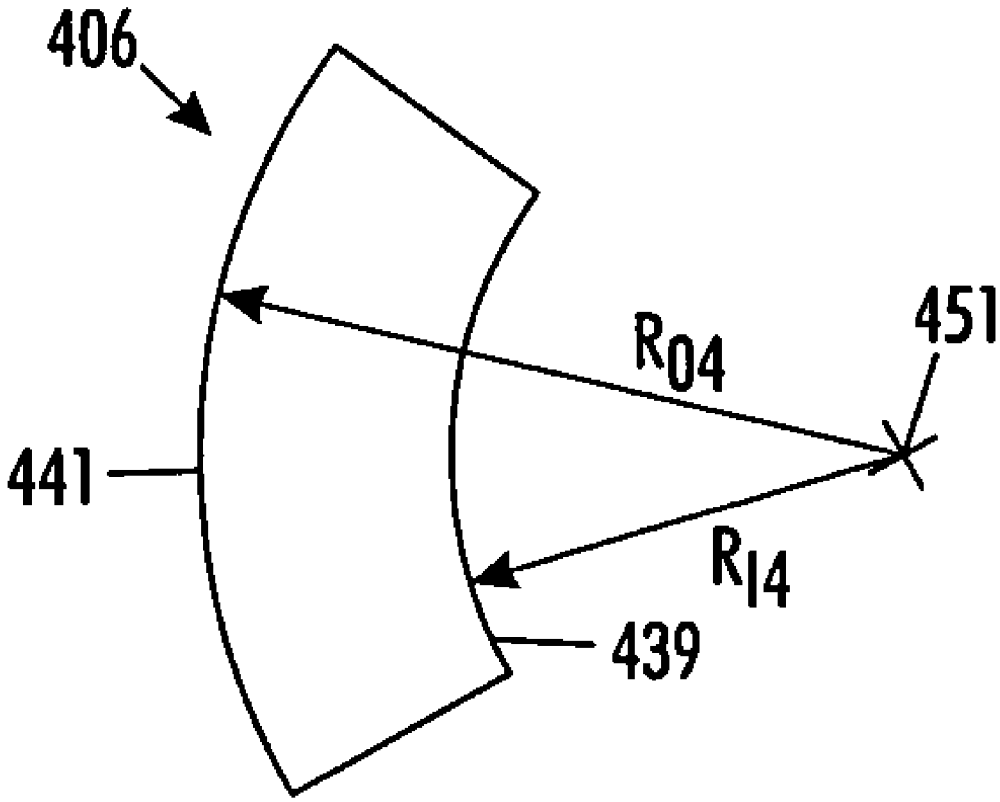
FIG. 18 is an plan view of an alternative ink stick according to the system disclosed herein for use with the printer of FIG. 17.

According to the system disclosed herein, and referring now to FIGS. 17 and 18, another embodiment of the system disclosed herein is shown as ink printer 402 which includes solid ink delivery ink system 404 that is somewhat different than the solid ink delivery system 204 of the ink printer 302 of FIGS. 14-15. The solid ink delivery system 404 of FIG. 16 includes a chute 417 which is different than the chute 317 of the solid ink delivery system 304 of FIGS. 18-20. The chute 417 is similarly an arcuate chute and is defined by radius RR extending from origin 426. The radius RR may be constant or may vary, for example, increase.

The chute 417, as shown in FIG. 17, has a path that crosses over itself, or in other words the upper portions of the chute 417 may be positioned over the lower portions of chute 417. The chute configuration of chute 417 may be conservative of space, that is, minimally intrusive or accommodating of general printer configuration constraints and other components or functions. It should be appreciated that a common cross section, such as the center, of the chute 417 may lie in a single plane or in a plurality of non-parallel planes. In other words, the chute 417 may form, for example, a spiral shape or a helical shape.

The chute 417 may have any size and shape and opening 427 of the chute 417 may, for example, be rectangular, triangular, pentagonal, or have any other shape. The size and shape of the opening 427 of the chute 417 is preferably complementary to the size and shape of the ink stick 406 to be positioned in the chute 417 so that the stick 406 may freely feed by gravity, if so oriented, down the chute 417 from the loading station 424 to delivery position 423 adjacent melting units 411.

According to the system disclosed herein and referring now to FIGS. 17 and 18, yet another embodiment of the system disclosed herein is shown as ink stick 406 for use in solid ink delivery system 404 of solid ink printer 402. The ink stick 406 includes a first external surface 439 that is concave and an opposed second external surface 441 that is convex. The first external surface 439 of ink stick 406 is defined by radius $R_{I4}$ extending from origin 451. Similarly, the second surface 441 of the ink stick 406 is defined by radius $R_{O4}$ extending from origin 451. The radii $R_{O4}$ and $R_{I4}$ are selected to have radii somewhere optimally in the middle of the range of radii RR to optimize stick mass and the conformance of the ink stick 406 to the chute 408 of the solid ink delivery system 404 of the printer 402. It should be noted that the ink stick may be configured with radii that do not somewhat match the form of the chute, in such cases feed performance may not be impeded but the stick may be reduced in mass, other factors excluded. As example, a small radius at the upper portion of the stick would remove mass near the ends but could maintain a complementary stick height relative to the chute configuration.

Figure 19:
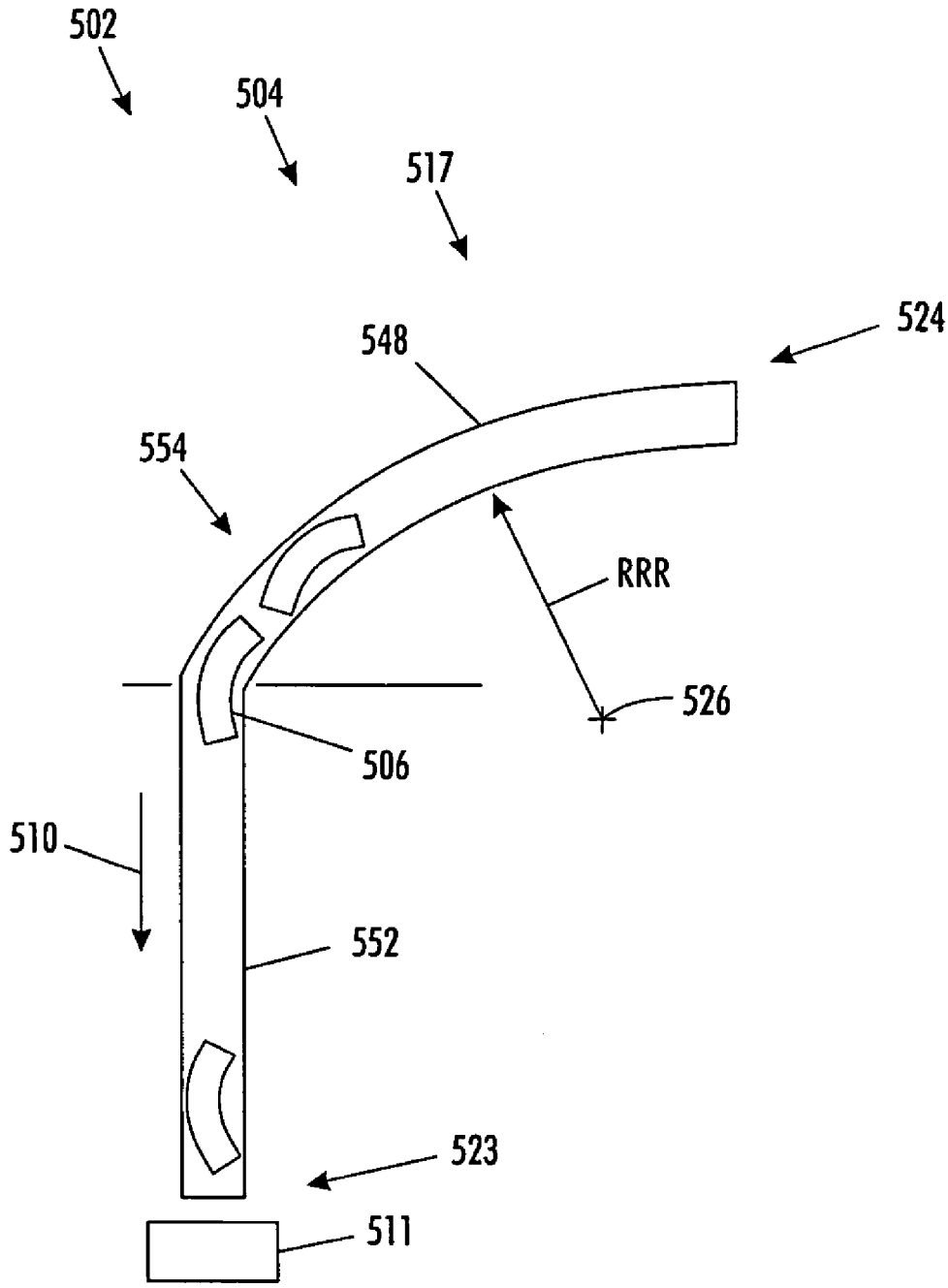
FIG. 19 is a plan view of a further embodiment of the solid ink delivery system of the system disclosed herein in the form of a solid ink delivery system with a chute having a linear portion and a curved portion.
Figure 20:
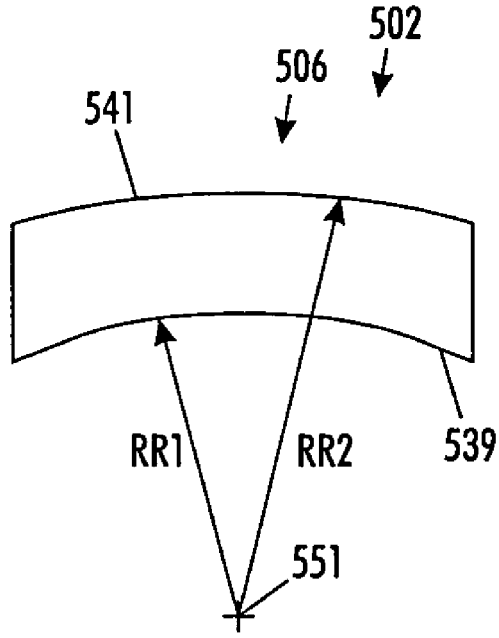
FIG. 20 is a plan view of the ink stick for use in the chute of the solid ink delivery system of FIG. 19.

Referring now to FIGS. 19 and 20, yet another embodiment of the system disclosed herein is shown as solid ink printer 502. The printer 502 includes a solid ink delivery system 504 that has a chute 517 that includes an arcuate upper portion 548 and a linear lower portion 552. The arcuate upper portion 548 may extend from the loading station 524 to the transition position 554 located between the arcuate upper portion 548 and the linear lower portion 552 of the chute 517. The arcuate upper portion 548 may be defined by radius RRR extending from origin 526. The linear lower portion 552 extends from the transition position 554 to delivery position 523 adjacent melting unit 511. The linear lower portion 552, as shown in FIG. 19, may be vertical. It should be appreciated that the linear portion 552 may, alternatively, be angled. Descriptions of chute shape are possibilities and are not intended to limit the scope or range of chute forms ranging from linear to arcuate to combinations of linear and arcuate and to non linear feed path planes applicable to this concept.

Figure 22:
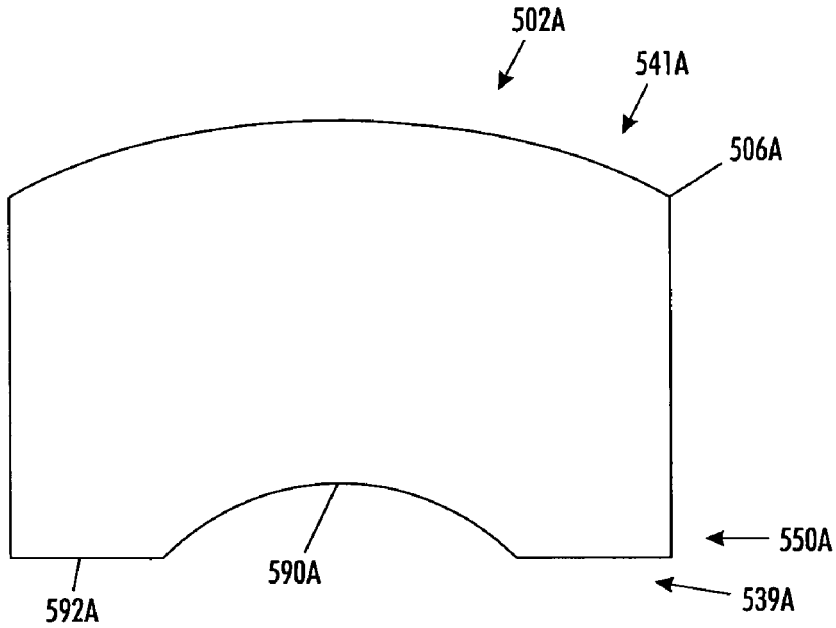
FIG. 22 is a plan view of an alternate ink stick for use in the chute of the solid ink delivery system of FIG. 19.

The ink stick 506 for use in the printer 502 may be rectangular or may, as is shown in FIG. 22, be arcuate. The arcuate shape of the ink stick 506 permits the motion of the stick 506 through the arcuate upper portion 548 and the transition position 554 of the chute 517.

Figure 21:
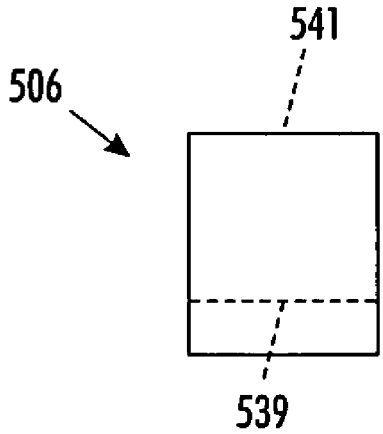
FIG. 21 is an end view of the ink stick of FIG. 20.

According to the system disclosed herein and referring now to FIGS. 19, 20, and 21, yet another embodiment of the system disclosed herein is shown as ink stick 506 for use in solid ink delivery system 504 of solid ink printer 502. The solid ink delivery system 504 utilizes a ink stick 506 that provides for optimum conformance with the chute 508 of the solid ink delivery system 504. As shown in FIG. 20, the ink stick 506 includes a first external surface 539 defined by radius RR1 extending from origin 551. Similarly, the stick 506 includes a second external 541 defined by radius RR2 extending from origin 551. The radii RR1 and RR2 are selected to conform with the RRR of the chute 508. The radius RR1 may, as shown in FIGS. 19 and 20, have a radius slightly larger than radius RRR.

Referring now to FIGS. 20 and 21, the ink stick 506 of the printer 502 is shown in greater detail. The ink stick 506 has a width CBW and a thickness CBT. The thickness CBT is defined by radius RR1 and RR2 extending from origin 551. Radii RR1 and RR2 may be optimized depending on the shape of the arcuate upper portion 548 and the linear lower portion 552 of the chute 517 of the delivery system 504 of the printer 502.

Figure 23:
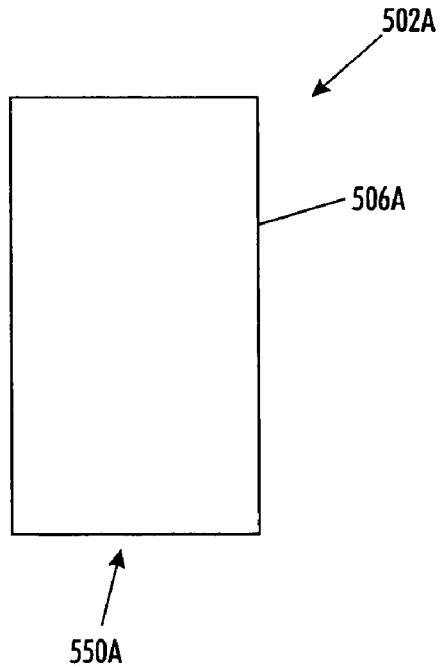
FIG. 23 is an end view of the ink stick of FIG. 22.

As shown in FIGS. 22 and 23, yet another embodiment of the system disclosed herein is shown as ink stick 506A which may alternatively be positioned in solid ink delivery system 504 of solid ink printer 502. The ink stick 506A is slightly different than the ink stick 506 of FIG. 21 in that the ink stick 506A of FIGS. 22 and 23, includes a first external surface 539A that includes an arcuate portion 590A as well as opposed linear portions 592A. The arcuate portion 590A is adapted to conform to the arcuate portion 548 of the chute 508 while the linear portions 592A of the first external surface 539A are adapted to conform to linear portion 552 of the chute 508. The ink stick 506A further includes a second external surface 541A which is adapted to conform to arcuate portion 548 of the solid ink chute 508.

Figure 24:
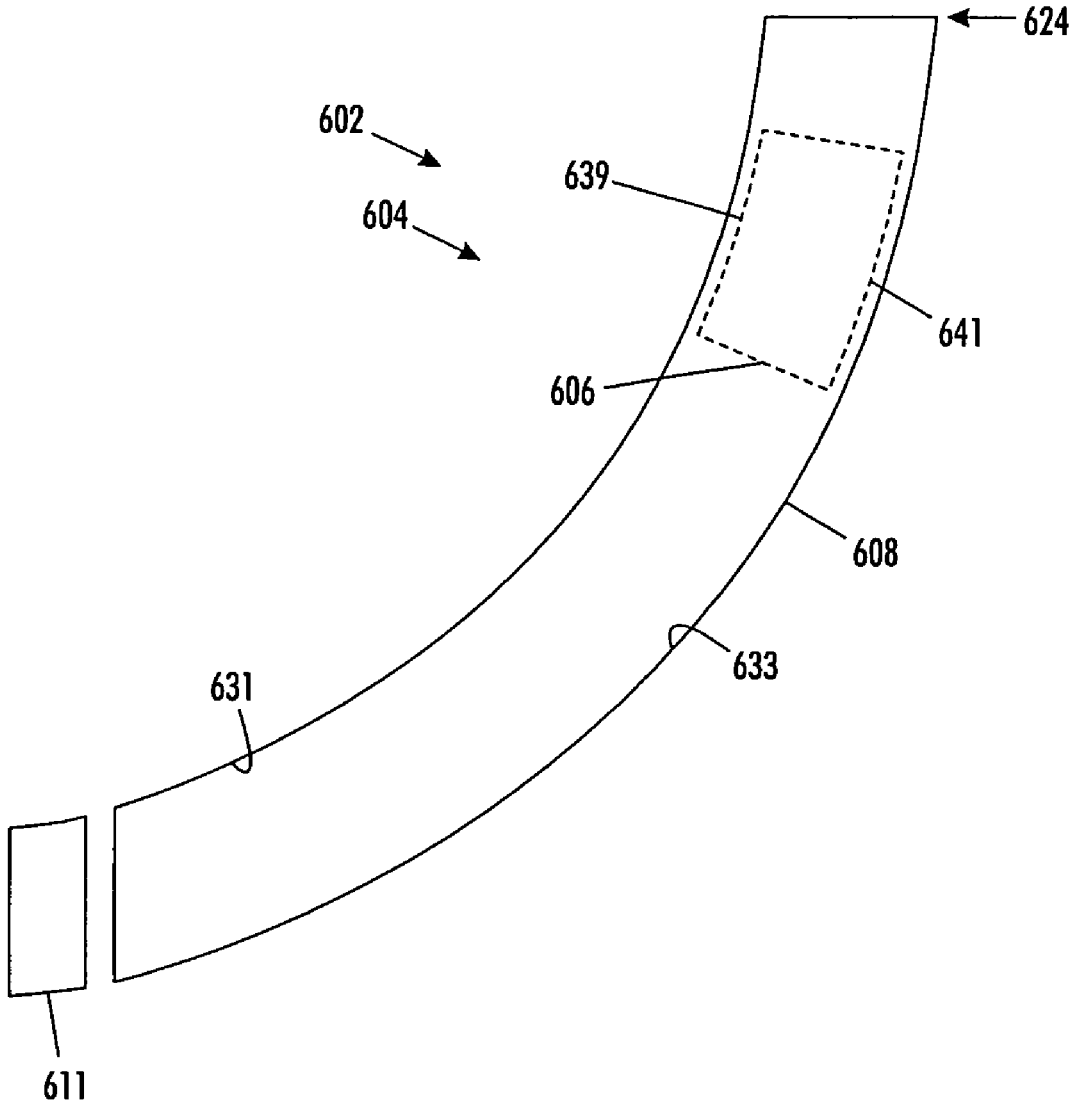
FIG. 24 is a plan view of a further embodiment of the solid ink delivery system of the system disclosed herein in the form of a solid ink delivery system with a chute having a constantly curved chute with vertical load and horizontal delivery.
Figure 25:
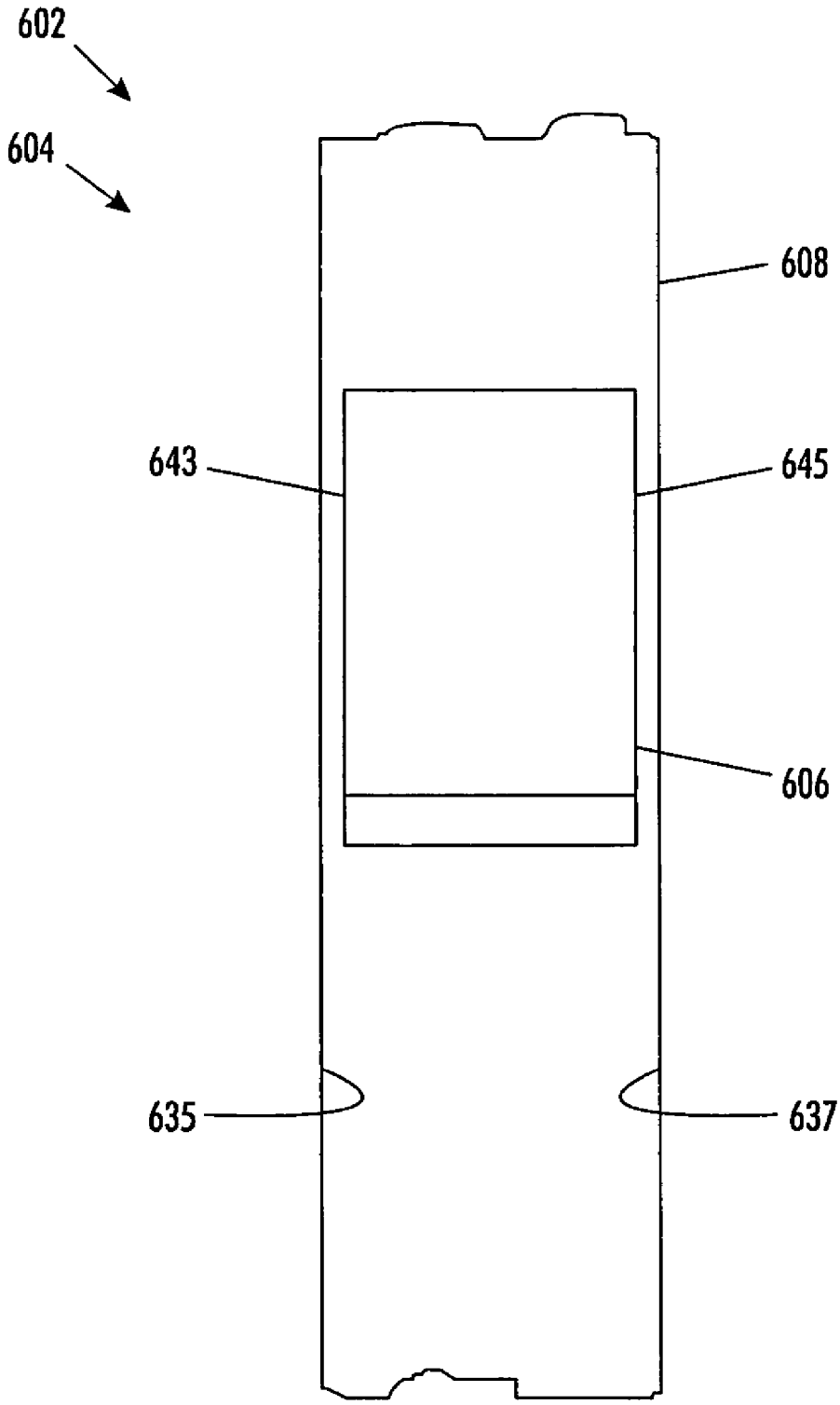
FIG. 25 is an end view of the solid ink delivery system of FIG. 24.
Figure 26:
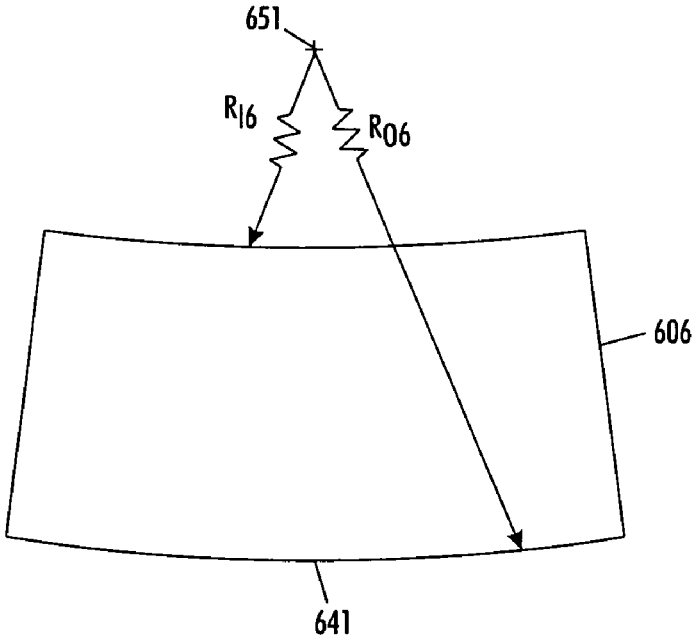
FIG. 26 is a plan view of an ink stick for use in the chute of the solid ink delivery system of FIG. 24 with opposed arcuate surfaces.

According to the system disclosed herein and referring now to FIGS. 24, 25, and 26, another embodiment of the system disclosed herein is shown as ink stick 606 for use in solid ink delivery system 604 of printer 602. The solid ink delivery system 604 includes a chute 608 which provides for vertical loading of the ink stick 606 at loading station 624. The ink stick 606 is delivered to melting station 611 in a horizontal position. The chute 608 is an arcuate chute and has the internal surface defined by first internal chute surface 631 which is convex and a second internal chute surface 633 which is concave. The stick 606 has a first external stick surface 639 which is concave and conforms with first internal chute surface 631. The stick 606 further includes a second external surface which is convex and mates with concave second internal chute surface 633.

Referring now to FIG. 25, the chute 608 receives the stick 606. The stick 606 includes a third external surface 643 which mates with third chute surface 635. The stick 606 further includes a fourth external surface 645 which mates with fourth internal chute surface 637 of the chute 608. The third external surface 643 and the fourth external surface 645 of the stick 606 may be linear or planar and conform with planar third surface 635 and planar fourth surface 637 of the chute 608.

Referring now to FIG. 26, the stick 606 includes the first surface 639 which is defined by radius $R_{O6}$ as well as an opposed second external surface 641 defined by $R_{I6}$. The radii $R_{O6}$ and $R_{I6}$ extend from origin 651. It should be appreciated that conformity of the chute to the stick need not be completely around the stick or for the entire length of the chute, but only need be sufficient for proper guidance of the stick through the chute.

Figure 27:
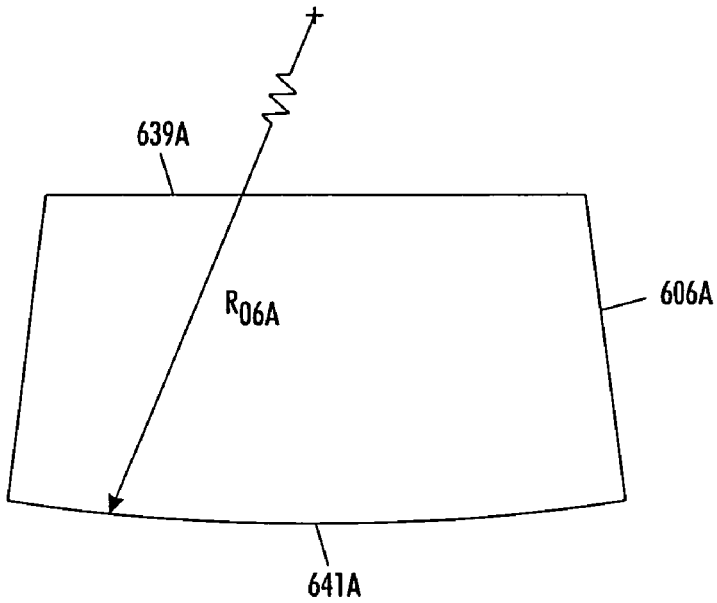
FIG. 27 is a plan view of an alternate ink stick for use in the chute of the solid ink delivery system of FIG. 24 with opposed arcuate and flat surfaces.

Referring now to FIG. 27, and alternate embodiment of the system disclosed herein is shown as ink stick 606A for use in solid ink delivery system 604 of solid ink printer 602 of FIGS. 24-26. The ink stick 606A is different from ink stick 606 of FIGS. 24-26 in that ink stick 606A includes a first external surface 639A that is flat or planar. The ink stick 606A includes a second external surface 641A defined by radius $R_{O6A}$ extending from origin 651A.

Figure 28:
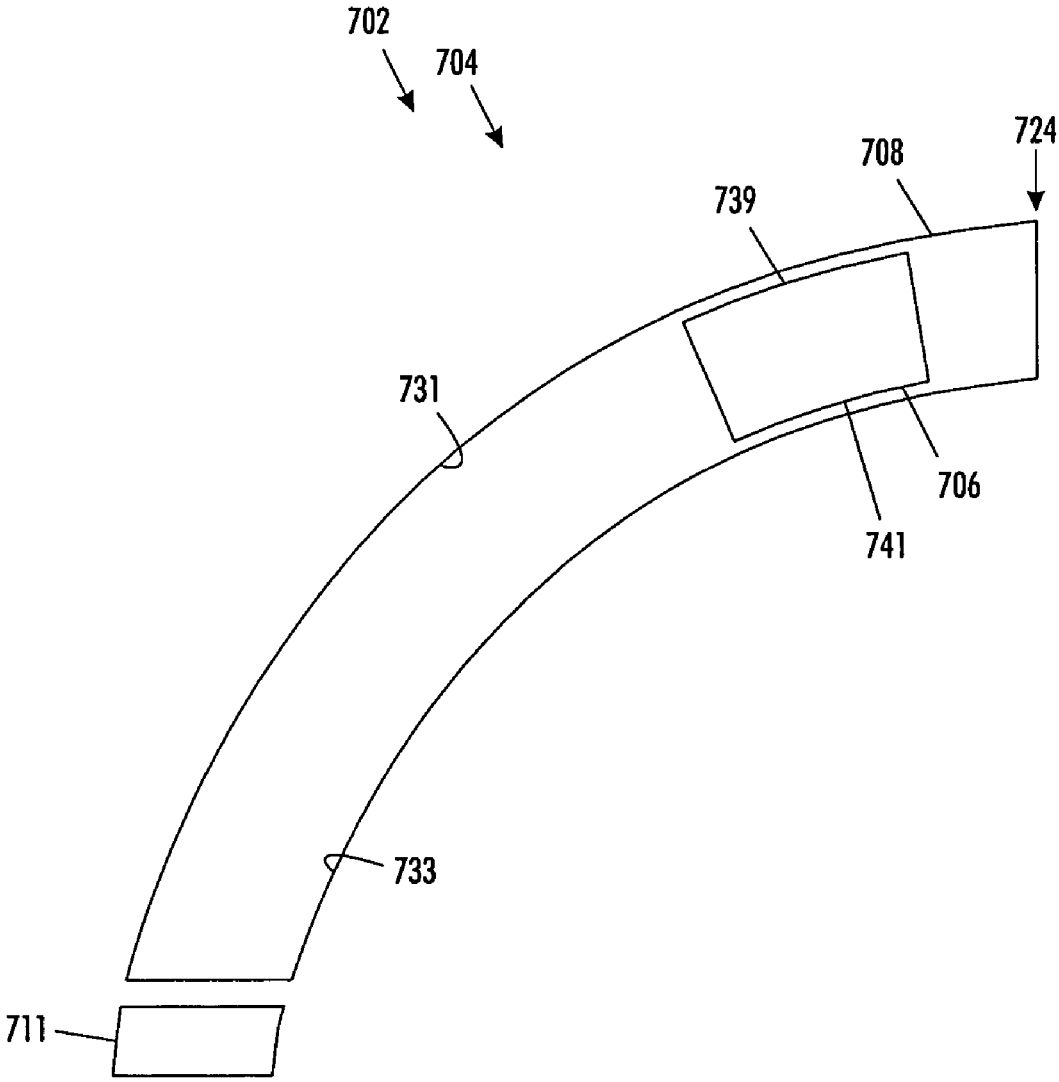
FIG. 28 is a plan view of a further embodiment of the solid ink delivery system of the system disclosed herein in the form of a solid ink delivery system with a chute having a constantly curved chute with horizontal load and vertical delivery.
Figure 29:
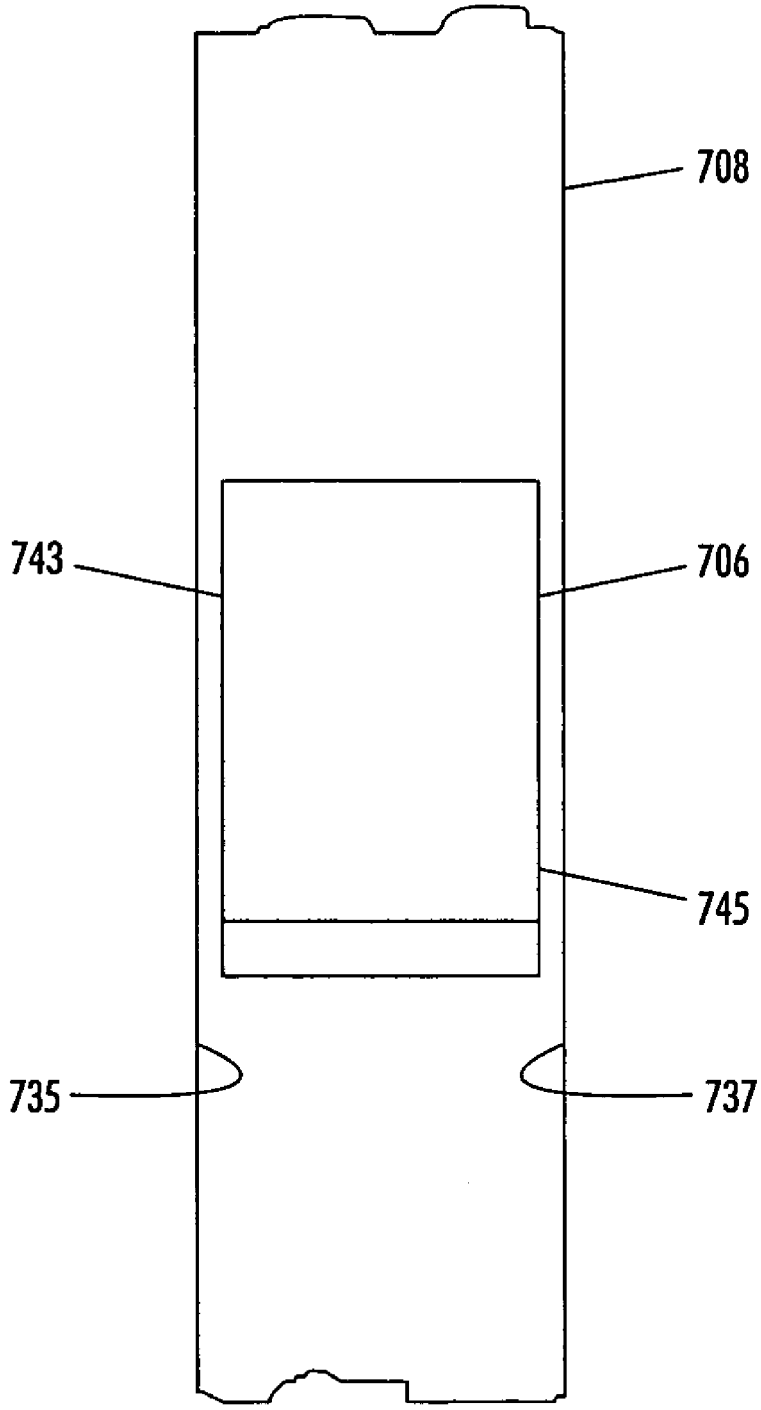
FIG. 29 is an end view of the solid ink delivery system of FIG. 24.
Figure 30:
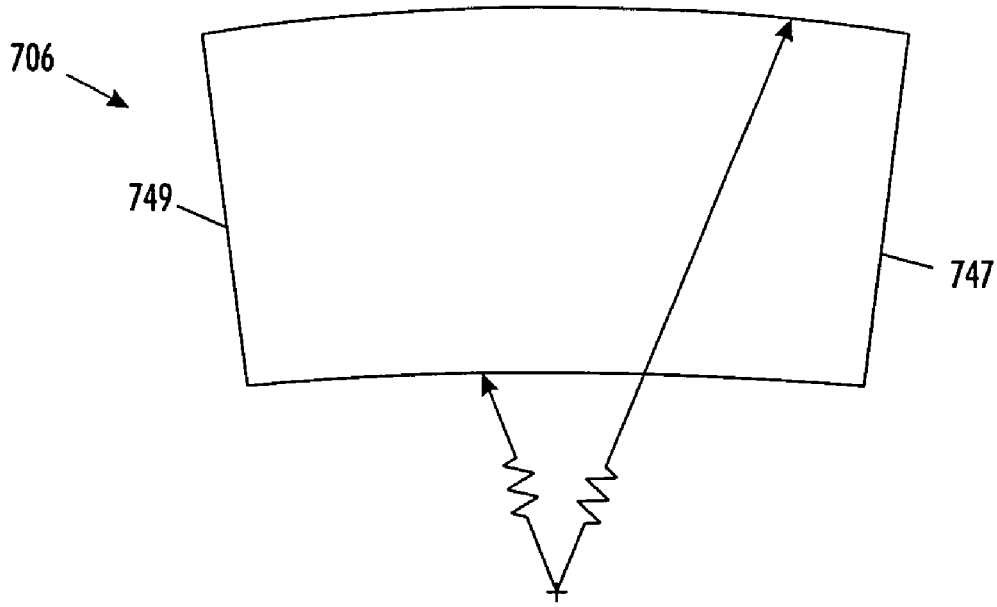
FIG. 30 is a plan view of the ink stick for use in the chute of the solid ink delivery system of FIG. 28.

Referring now to FIGS. 28, 29, and 30, yet another embodiment of the system disclosed herein is shown as ink stick 706 for use in solid ink delivery system 704 of printer 702. The solid ink delivery system 704 provides for horizontal loading of ink stick 706 and for delivery of ink stick 706 vertically to melting unit 711. The ink stick 706 is inserted into chute 708 at loading station 724 and is delivered to melting unit 711. The ink stick 706 closely conforms to chute 708.

Referring now to FIG. 28, the stick 706 includes a convex first external surface 739 and an opposed concave second external surface 741. The chute 708 includes a first internal surface 731 that is concave and conforms to convex first external surface 739 of the stick 706. Similarly, the chute 708 includes a second internal surface 733 that is convex and mates with concave second external surface 741 of the stick 706.

Referring now to FIG. 29, the stick 706 further includes a third external surface 743 that, as shown in FIG. 29, is planar of flat. The third external surface 743, of the stick 706, mates with a planar third internal surface, 735 of the chute 708. The stick 706 further includes a fourth external surface 745 that is planar and mates with fourth internal surface 737, of the chute 708. The fourth internal surface 737 is, likewise, flat or planar.

Referring now to FIG. 30, the stick 706 is shown in greater detail. The stick 706 further includes fifth external surface 747 and opposed sixth external surface 749.

Figure 31:
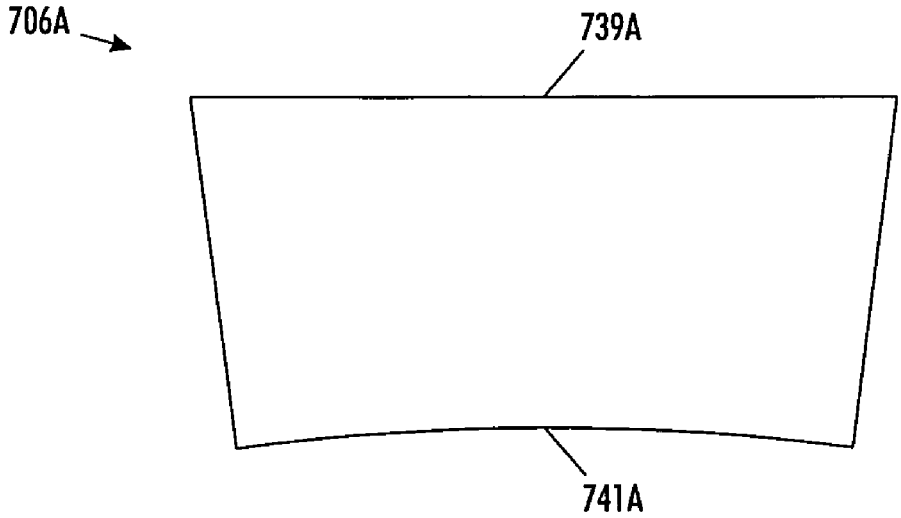
FIG. 31 is a plan view of an alternate ink stick for use in the chute of the solid ink delivery system of FIG. 28.

Referring now to FIG. 31, yet another embodiment of the system disclosed herein is shown as ink stick 706A for use in solid ink printer 702, of FIGS. 28, 29, and 30. The ink stick 706A includes a first external surface 739A that is flat or planar. Ink stick 706A further includes an opposed second external surface 741A that is concave and conforms to second internal surface 733 of the chute 708 of FIGS. 28 and 29.

Figure 32:
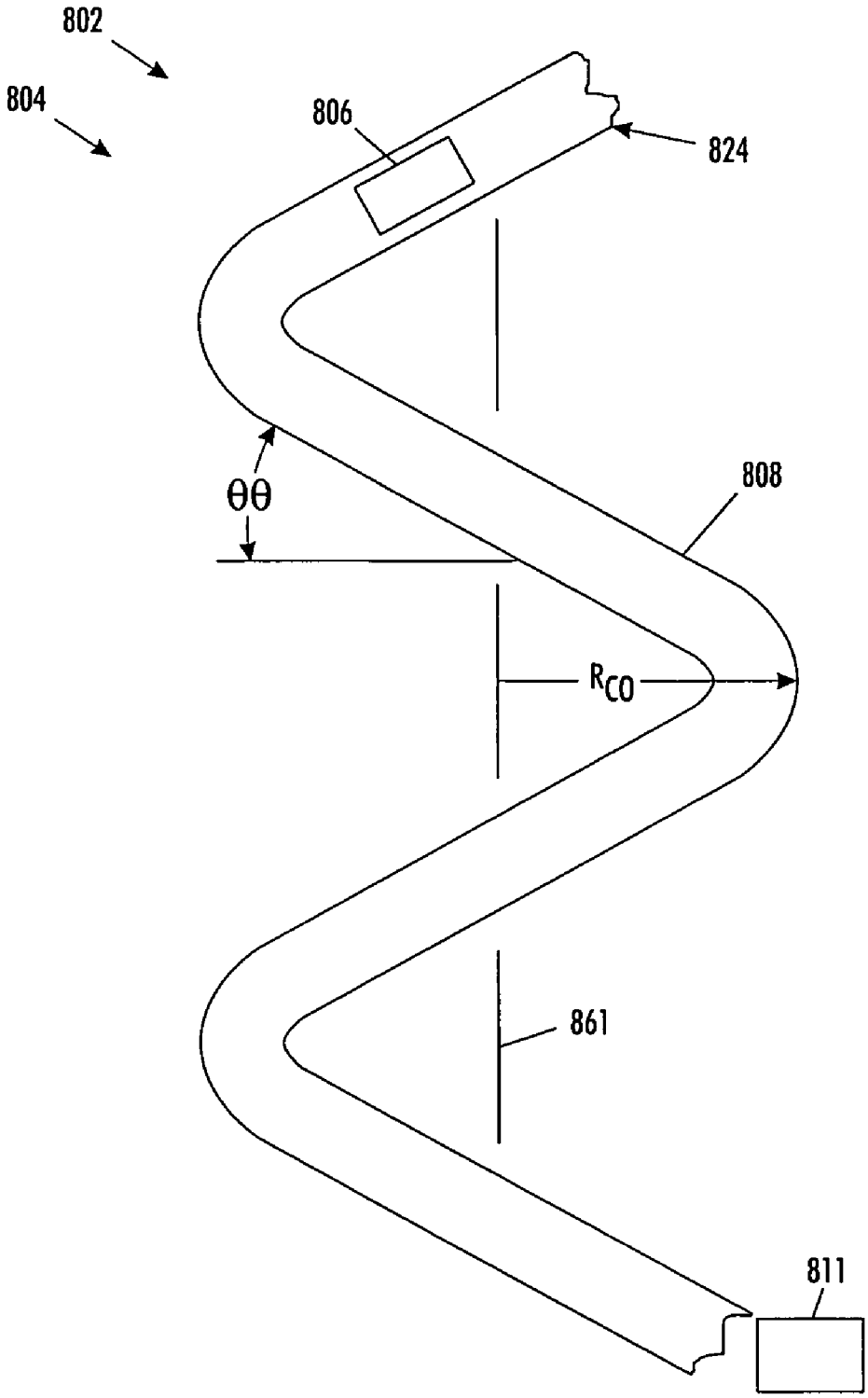
FIG. 32 is a plan view of a further embodiment of the solid ink delivery system of the system disclosed herein in the form of a solid ink delivery system with a helical chute having a constantly curved chute, both horizontally and vertically.

According to the system disclosed herein and referring now to FIGS. 32-35, yet another embodiment of the present is shown as ink stick 806 for use in solid delivery system 804 for printer 802. The solid ink stick delivery system, as shown in FIG. 32, is in the form of an outwardly spiraling chute 808 extending from loading position 824 to melting unit 811. The chute 808 is defined by radius $R_{C0}$ extending from vertical center line 861. The chute 808 is further defined by a lead angle θθ.

Figure 33:
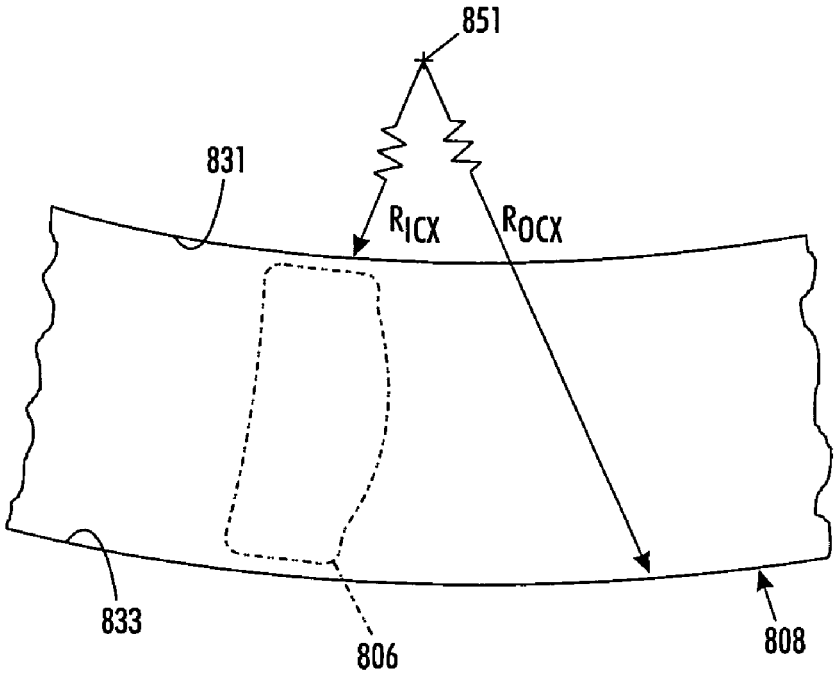
FIG. 33 is an plan view of the solid ink delivery system of FIG. 32.

Referring now to FIG. 33, the chute 808 includes a first internal surface 831 defined by radius $R_{ICX}$ extending from origin 851. The first internal surface 831 is convex. The chute 808 is further defined by a second internal surface 833 defined be radius $R_{OCX}$ extending from origin 851.

Figure 34:
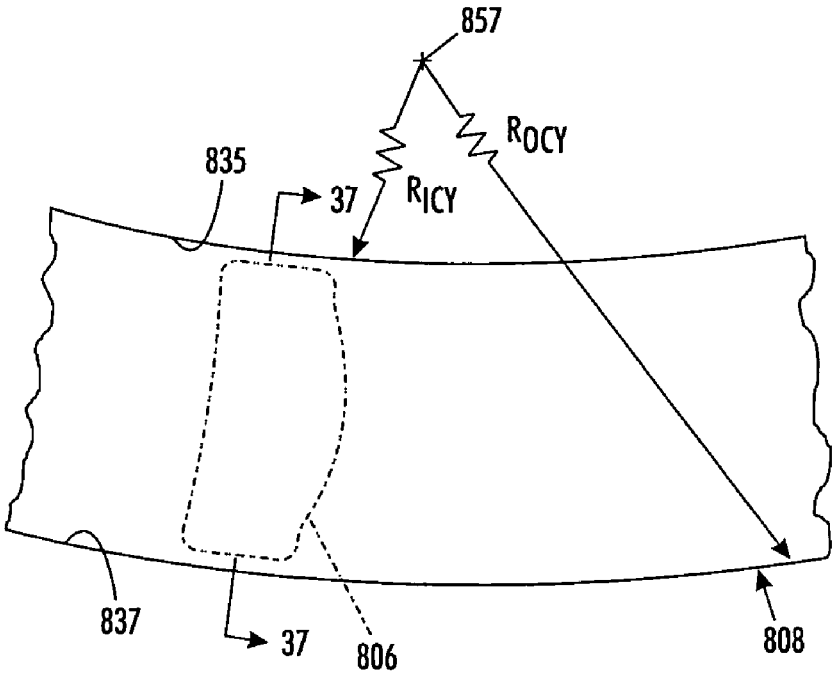
FIG. 34 is an top view of the solid ink delivery system of FIG. 32.

Referring now to FIG. 34, the chute 808 is further defined by third internal surface 835 which is defined by radius $R_{ICY}$ extending from origin 857. The chute 808 further includes a fourth internal surface 837 which is defined by radius $R_{OCY}$ extending from origin 857. The third internal surface 835 is convex while the fourth internal surface 837 is concave.

Figure 35:
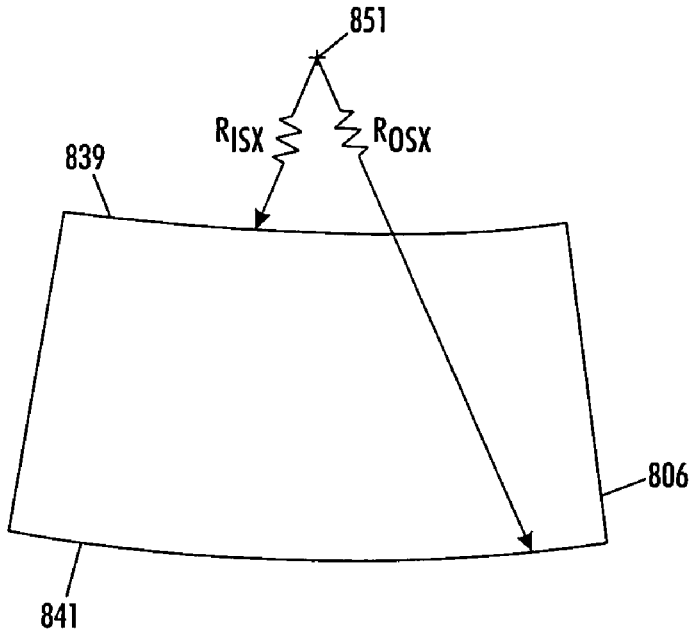
FIG. 35 is a plan view of an ink stick for use in the chute of the solid ink delivery system of FIG. 32.
Figure 36:
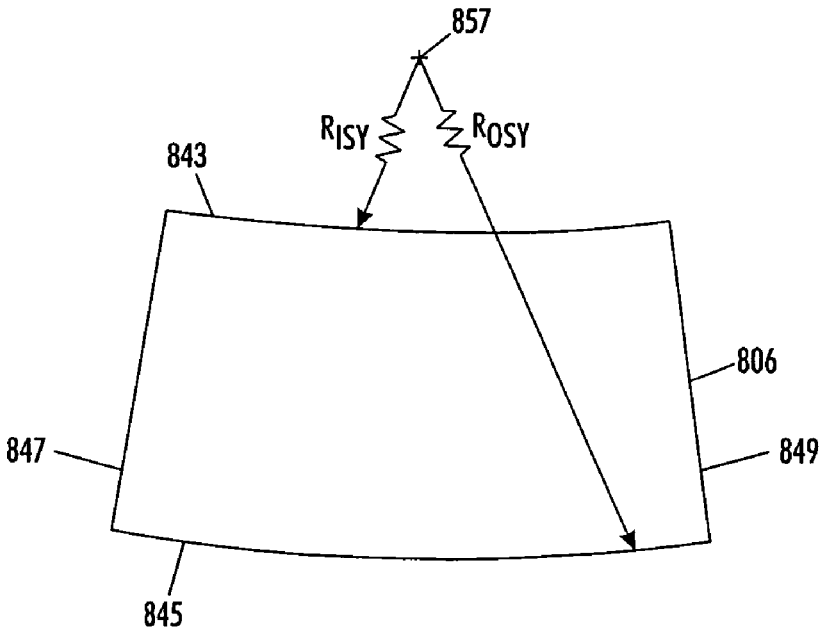
FIG. 36 is a top view of an ink stick for use in the chute of the solid ink delivery system of FIG. 32.

Referring now to FIGS. 35 and 36, the ink stick 806 is shown in greater detail. As shown in FIG. 35, the stick 806 includes a first external surface 839 defined by radius $R_{ISX}$ extending from origin 851. The stick 806 further includes a second external surface 841 defined by radius $R_{OSX}$ extending from origin 851.

Referring now to FIG. 36, the stick 806 further includes a third external surface 843 defined by radius $R_{ISY}$ extending from origin 857. The third external surface is concave. The stick 806 further includes a fourth external surface 845 which is convex. The fourth external surface may be defined by, for example, radius $R_{OSY}$ extending from origin 857. The stick 806 may further include a fifth external surface 847 and a sixth external surface 849.

Figure 37:
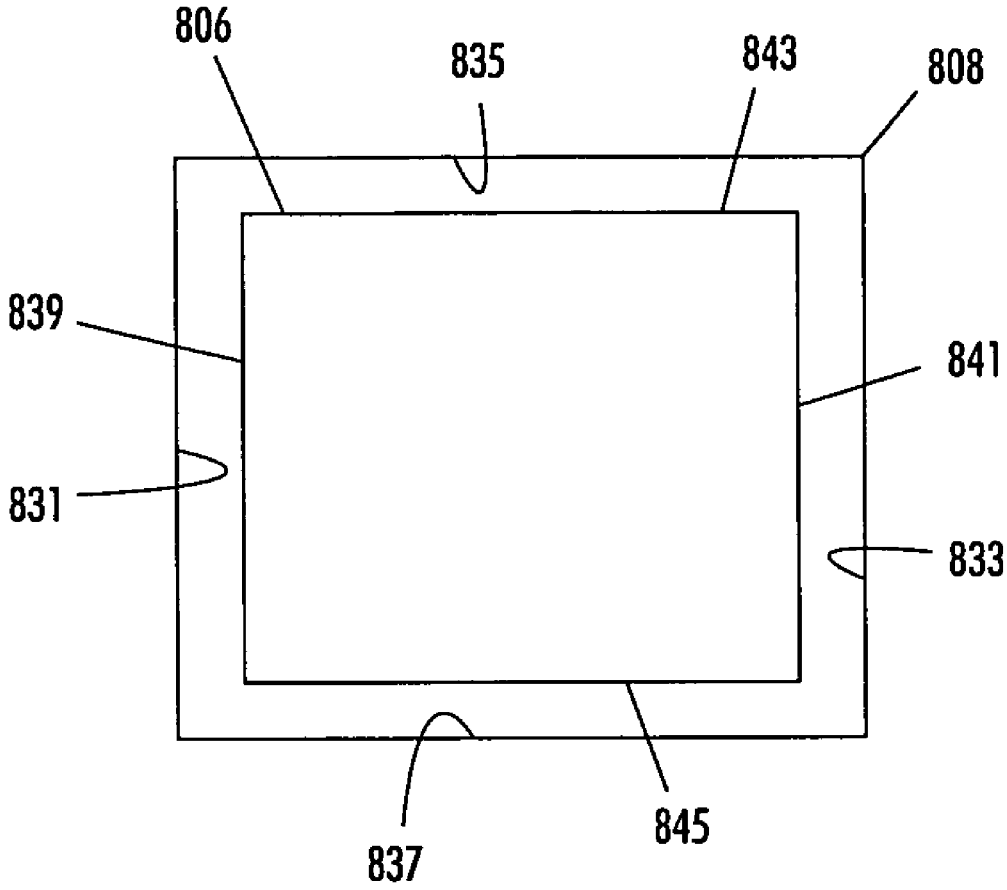
FIG. 37 is a cross sectional view of FIG. 33 along the line 37-37 in the direction of the arrows.

Referring now to FIG. 37, the stick 806 is shown in position is chute 808. Stick 806 includes first external surface 839 which mates with first internal surface 831 of chute 808. The chute further includes a second internal surface 833 which mates with second external surface 841 of the stick 806. Further, the chute 808 includes a third internal surface 835 that mates with third external surface 843 of the stick 806. Further, the chute 808 includes a fourth internal surface 837 which mate with fourth external surface 845 of stick 806.

Variations and modifications of the system disclosed herein are possible, given the above description. However, all variations and modifications which are obvious to those skilled in the art to which the system disclosed herein pertains are considered to be within the scope of the protection granted by this Letters Patent.

What is claimed is:

1. A solid ink stick for use in solid ink printers comprising:

a first external surface;

a second external surface, the first external surface being configured to enter a chute of a solid ink delivery system in a solid ink printer before the second external surface enters the chute of the solid ink delivery system;

a third external surface that extends from the first external surface to the second external surface; and a fourth external surface that extends from the first external surface to the second external surface, the fourth external surface being on a side of the solid ink stick that is opposite the third external surface of the solid ink stick, and at least one of said third external surface and said fourth external surface being at least partially arcuate in a direction between the first external surface and the second external surface.

2. The solid ink stick of claim 1 wherein said third external surface is at least partially arcuate in the direction between the first external surface and the second external surface and said fourth external surface is at least partially arcuate in the direction between the first external surface and the second external surface.

3. The solid ink stick of claim 1 wherein the third external surface is concave.

4. The solid ink stick of claim 3 wherein the fourth external surface is convex.

5. The solid ink stick of claim 1 wherein at least one of said first external surface and said second external surface being is at least partially arcuate.

* * * * *